US010315833B2

(12) United States Patent
Erdmann et al.

(10) Patent No.: US 10,315,833 B2
(45) Date of Patent: Jun. 11, 2019

(54) BLADE DISPENSER

(71) Applicant: AccuTec Blades, Inc., Verona, VA (US)

(72) Inventors: Paul Philipp Erdmann, Hong Kong (CN); Jeffrey Wonderley, Fort Defiance, VA (US)

(73) Assignee: ACCUTEC BLADES, INC., Verona, VA (US)

( * ) Notice: Subject to any disclaimer, the term of this patent is extended or adjusted under 35 U.S.C. 154(b) by 0 days.

(21) Appl. No.: 15/035,177

(22) PCT Filed: Nov. 7, 2014

(86) PCT No.: PCT/US2014/064510

§ 371 (c)(1),
(2) Date: May 6, 2016

(87) PCT Pub. No.: WO2015/069992

PCT Pub. Date: May 14, 2015

(65) Prior Publication Data

US 2016/0304269 A1 Oct. 20, 2016

Related U.S. Application Data

(60) Provisional application No. 61/901,078, filed on Nov. 7, 2013.

(51) Int. Cl.

| | |
|---|---|
| ***B65D 83/10*** | (2006.01) |
| ***B26B 21/54*** | (2006.01) |
| ***B65D 83/08*** | (2006.01) |

(52) U.S. Cl.

CPC ..... *B65D 83/10* (2013.01); *B26B 21/54* (2013.01); *B65D 83/0817* (2013.01); *B65D 83/0829* (2013.01)

(58) Field of Classification Search

CPC ..... B65D 83/10; B65D 83/0817; B65D 83/0829; B26B 21/54

(Continued)

(56) References Cited

U.S. PATENT DOCUMENTS

| | | | |
|---|---|---|---|
| 1,350,886 | A | 8/1920 | Scholz |
| 1,654,554 | A | 1/1928 | Pasch |

(Continued)

FOREIGN PATENT DOCUMENTS

| | | | |
|---|---|---|---|
| CA | 127032 | S | 7/2009 |
| CA | 127039 | S | 7/2009 |

(Continued)

OTHER PUBLICATIONS

European Search Report issued in European Patent Application No. 09705689.9.

(Continued)

*Primary Examiner* — Rakesh Kumar
(74) *Attorney, Agent, or Firm* — McGuireWoods LLP

(57) ABSTRACT

A blade dispenser is provided that includes a housing, a carrier, and a blade eject assembly. The housing defines a carrier cavity having an open end, and includes a blade loading mechanism. The carrier is operable to hold a plurality of blades. The carrier is selectively disposable within the carrier cavity of the housing. The blade eject assembly includes a button biased in a normal position relative to a base. The button is operable to be moved relative to the base and engage a blade disposed within the carrier, and to move the blade to a position where at least a part of the blade is disposed outside the housing.

20 Claims, 25 Drawing Sheets

(58) Field of Classification Search
USPC ..... 221/154, 279, 244
See application file for complete search history.

(56) References Cited

U.S. PATENT DOCUMENTS 2,094,722 A 10/1937 Sandford
2,272,444 A 2/1942 Testi
2,295,464 A 9/1942 Garbaty
2,303,764 A 12/1942 Roberts
2,309,780 A 2/1943 Muros
2,321,570 A 6/1943 Billing
2,344,962 A 3/1944 Benjamin
2,431,523 A * 11/1947 Tuerff ..... B65D 83/10 221/198
2,439,243 A 4/1948 Dalkowitz
2,458,020 A 1/1949 Olsen
D156,909 S 1/1950 Nelson
2,522,896 A 9/1950 Rifkin et al.
2,564,712 A 8/1951 Muros et al.
2,624,453 A 1/1953 Muros
2,637,900 A 5/1953 Thompson
2,641,358 A 6/1953 Santo
2,653,704 A 9/1953 Nelson
2,684,151 A 7/1954 Arrighi
2,685,364 A 8/1954 Treiss
D179,225 S 11/1956 Smith
2,792,933 A 5/1957 Butlin
2,829,764 A 4/1958 Silverman
2,889,076 A 6/1959 Van Schie
D187,224 S 2/1960 Jakeway
D187,389 S 3/1960 Becker
D187,562 S 3/1960 Zierhut
2,946,482 A 7/1960 Johnson
2,971,676 A 2/1961 Honcharenko
3,037,664 A 6/1962 Kuhnl
3,040,929 A 6/1962 Tapper
3,070,260 A 12/1962 Smith
3,080,998 A 3/1963 La Cas
3,093,266 A 6/1963 Kuhnl
3,115,991 A 12/1963 Carew et al.
3,373,862 A 3/1968 Minchin
3,460,712 A 8/1969 Lowry
3,542,245 A 11/1970 Braginetz
3,543,918 A 12/1970 Borden et al.
3,549,046 A 12/1970 Iten
3,563,412 A 2/1971 James
3,612,348 A 10/1971 Thomas
3,667,122 A 6/1972 Black
D227,753 S 7/1973 Muncy
3,767,083 A 10/1973 Webb
D231,202 S 4/1974 Stratford et al.
D231,670 S 5/1974 Haworth et al.
3,827,597 A 8/1974 Braginetz
3,850,343 A 11/1974 Petrillo
3,869,066 A 3/1975 Ferraro
D235,135 S 5/1975 Poisson
D240,116 S 6/1976 Poisson
D240,902 S 8/1976 Byrne
4,114,780 A 9/1978 Sharon
4,151,931 A 5/1979 Scherer et al.
D252,558 S 8/1979 Beck
D252,853 S 9/1979 Perkins
4,207,790 A 6/1980 Endo
D260,054 S 8/1981 Morgan
D260,489 S 9/1981 Pritchard
4,316,554 A 2/1982 Lloyd
4,379,514 A 4/1983 Joffe
4,430,012 A 2/1984 Kooy et al.
4,730,376 A 3/1988 Yamada
4,789,080 A 12/1988 Iten
4,792,058 A 12/1988 Parker
D299,288 S 1/1989 Stafford
4,826,042 A 5/1989 Vujovich
4,850,512 A 7/1989 Vujovich
D303,082 S 8/1989 Iten
4,852,379 A 8/1989 Levenberg
D307,670 S 5/1990 Nava
D317,985 S 7/1991 Alm
5,139,167 A 8/1992 McCarthy
5,148,916 A 9/1992 Tillyer, Sr.
5,251,783 A 10/1993 Gringer
D341,568 S 11/1993 Sorenson et al.
5,305,913 A 4/1994 Shade
5,536,472 A * 7/1996 Terashima ..... G01N 35/00029 221/198
D390,103 S 2/1998 Gerson
D392,157 S 3/1998 Shibuya
D403,954 S 1/1999 Okada et al.
D407,972 S 4/1999 Hilton
6,082,581 A 7/2000 Anderson et al.
6,102,098 A 8/2000 Randazzo
D432,911 S 10/2000 Clarke et al.
D433,940 S 11/2000 Lindsay et al.
6,158,616 A 12/2000 Huang
6,382,460 B1 5/2002 Gonzalez
6,508,380 B1 * 1/2003 von Schuckmann ..... B65D 83/0835 221/155
D474,402 S 5/2003 Baerenwald
6,598,761 B1 6/2003 Chou
6,763,972 B2 7/2004 Graupner
6,796,455 B2 9/2004 Schmidt
D519,469 S 4/2006 Sorenson
D522,855 S 6/2006 Liebe et al.
D527,995 S 9/2006 Tanner
7,140,650 B2 11/2006 Berg
D536,624 S 2/2007 Novak et al.
D540,539 S 4/2007 Gutierrez
D546,671 S 7/2007 Cronin et al.
D550,632 S 9/2007 Samuels et al.
D554,468 S 11/2007 Ahlgren
D555,512 S 11/2007 Lam
D561,047 S 2/2008 Shields
D595,152 S 6/2009 van Deursen
D596,046 S 7/2009 van Deursen
7,641,072 B1 1/2010 Vlastakis et al.
D613,147 S 4/2010 Ito
D624,833 S 10/2010 van Deursen
D650,986 S 12/2011 Brady et al.
D702,649 S 4/2014 Ichio
8,809,726 B2 * 8/2014 Nakajima ..... B23K 11/3072 219/86.25
D720,628 S 1/2015 Erdmann
D727,272 S 4/2015 Johnson
9,039,977 B2 * 5/2015 Chan ..... B65D 83/0829 422/547
D742,760 S 11/2015 Garavaglia et al.
9,248,949 B2 * 2/2016 Leifeld ..... A61J 7/0481
9,505,544 B2 * 11/2016 Leifeld ..... A61J 7/0076
9,522,774 B2 * 12/2016 Gringer ..... B65D 83/10
D779,338 S 2/2017 Wonderley
2002/0162849 A1 11/2002 Chen
2003/0146236 A1 8/2003 Chou
2004/0099682 A1 5/2004 Huang
2004/0178214 A1 9/2004 Wei
2004/0178216 A1 9/2004 Brickwood et al.
2004/0200080 A1 10/2004 Lauri
2005/0230411 A1 * 10/2005 Veo ..... F42B 39/02 221/185
2005/0281706 A1 12/2005 Funke et al.
2006/0049201 A1 3/2006 Lanz
2007/0034640 A1 2/2007 Casale
2007/0185449 A1 8/2007 Mernoe
2008/0217353 A1 9/2008 Newman et al.
2009/0194557 A1 * 8/2009 Van Deursen ..... B65D 83/10 221/232
2011/0042406 A1 * 2/2011 Nakajima ..... B23K 11/115 221/244
2011/0233229 A1 9/2011 Schekalla
2011/0315706 A1 12/2011 Lockwood et al.
2012/0006844 A1 1/2012 Kobayashi
2012/0024881 A1 2/2012 Papaloizou et al.

(56) References Cited

U.S. PATENT DOCUMENTS

| | | | | |
|---|---|---|---|---|
| 2013/0015198 | A1* | 1/2013 | Bollmus | A45C 11/20 221/150 R |
| 2013/0126550 | A1 | 5/2013 | Schneider et al. | |
| 2013/0291955 | A1 | 11/2013 | Laible | |
| 2014/0034665 | A1 | 2/2014 | Walter | |
| 2014/0086796 | A1* | 3/2014 | Giraud | G01N 33/48757 422/68.1 |
| 2015/0114997 | A1 | 4/2015 | Uldry et al. | |
| 2016/0016778 | A1 | 1/2016 | Taylor | |
| 2016/0069859 | A1* | 3/2016 | Prais | G01N 33/48757 422/68.1 |
| 2016/0242765 | A1 | 8/2016 | George et al. | |
| 2016/0304269 | A1* | 10/2016 | Erdmann | B65D 83/0817 |
| 2017/0174412 | A1* | 6/2017 | Wonderley | B65D 83/10 |

FOREIGN PATENT DOCUMENTS

| | | | |
|---|---|---|---|
| CA | 127047 | S | 7/2009 |
| CA | 2713708 | A1 | 8/2009 |
| CN | 200830138544 | | 11/2009 |
| CN | 200830139300 | | 1/2010 |
| CN | 200830211300 | | 1/2010 |
| CN | 101970312 | A | 2/2011 |
| DE | 815829 | C | 10/1951 |
| DE | 4117356 | A1 | 12/1992 |
| EM | 000977582-0001 | | 7/2008 |
| EM | 000977590-0001 | | 7/2008 |
| EM | 000977632-0001 | | 7/2008 |
| EM | 002454512-0001 | | 4/2014 |
| EP | 1731447 | A1 | 12/2006 |
| EP | 2240388 | A1 | 10/2010 |
| EP | 2301861 | A1 | 3/2011 |
| EP | 3066031 | A1 | 9/2016 |
| FR | 2460643 | A1 | 1/1981 |
| FR | 2723725 | A1 | 2/1996 |
| GB | 2033344 | A | 5/1980 |
| GB | 2504852 | A | 2/2014 |
| HK | 1146538 | | 6/2011 |
| JP | 200062869 | A | 2/2000 |
| JP | D1112607 | S | 6/2001 |
| JP | D1142823 | S | 6/2002 |
| MX | 2010008445 | A | 1/2011 |
| TW | 135653 | | 6/1990 |
| TW | 462608 | | 11/2001 |
| TW | D130181 | | 8/2009 |
| TW | D130182 | | 8/2009 |
| TW | D130397 | | 8/2009 |
| WO | 2009097521 | A1 | 8/2009 |

OTHER PUBLICATIONS

Taiwanese Search Report issued in Taiwanese Design Application No. 097304388. dated Mar. 30, 2009. English Translation provided.
International Search Report issued in International Patent Application No. PCT/US2009/032631, dated Mar. 13, 2009.
http://www.artistcraft.com/Tools/Cups_Cutting_Caulking_Equip/193, retrieved Feb. 11, 2008.
Imedger retrieved from http://www.imedger.com/pages/framedger.html, retrieved Feb. 5, 2008.
Red Personna Precision 'Zipak' Dispenser and Razor Blades retrived from http://cgi.ebay.com/RED-PERSONNA-PRECISION-ZIPAK-DISPENSER-RAZOR-BLADES-W0QQitemZ110161800345QQihZ001QQcategoryZ35989QQrdZ1QQssPageNameZWD1VQQtrksidZp1638.m118.11247QQcmdZViewItem. Retrieved Feb. 11, 2008.
Sectioning and Microtomy Supplies, retrieved Feb. 5, 2008 from http://www.aname.es/microscopia/ems/histology/sectioning.html.
http://packandseal.com/CuttersRazor.html, retrieved Feb. 11, 2008.
http://www.tool-up.co.uk/shop/diy/STA028510.html, retrieved Feb. 11, 2008.
International Search Report issued in related co-pending PCT/US2016/67000 dated Mar. 31, 2017.
Office Action issued in related European Patent Application No. 14 806 127 dated Jun. 9, 2017.
International Search Report issued in WO2015069992.
Communication pursuant to Article 94(3) EPC dated Nov. 21, 2017, issued in related co-pending European Application No. 14806127.8.

* cited by examiner

BLADE DISPENSER

CROSS REFERENCE TO RELATED APPLICATIONS

This application claims the benefit of U.S. provisional patent application Ser. No. 61/901,078, filed Nov. 7, 2013, the content of which is incorporated herein for reference in its entirety.

BACKGROUND OF THE INVENTION

Technical Field

The present invention relates to blade dispensers in general, and to blade dispensers for safely handing blades in particular.

Background Information

Blade dispensers are used to conveniently store and dispense a number of blades, such as standard, single-edge razor blades. Some of these blades have one sharp blade edge at the bottom, and an opposed, safe top edge with a folded-over protective cap that can be metal. These blades are typically used for scraping and cutting. Conventional blade dispensers require the user to catch a small protruding portion of the blade with the edge of a finger or fingernail, and push the blade slightly out through a slot in the front of the dispenser. Typically, at this point the blade to be dispensed is slightly extended sideways from the dispenser, exposing both a portion of the safe top edge and the sharp blade edge. The blade is then grasped with the thumb and forefinger and removed from the dispenser. One disadvantage of conventional dispensers is that many users find it difficult to catch a small portion of the blade with their finger or fingernail, which may be injured in the attempt to catch the blade portion. Moreover, exposure of a portion of the sharp blade edge during the dispensing process exposes the user's fingers to injury. There exists a need for a blade dispenser that dispenses blades easily and safely

SUMMARY OF THE INVENTION

According to an aspect of the present invention, a blade dispenser is provided that includes a housing, a carrier, and a blade eject assembly. The housing defines a carrier cavity having an open end, and includes a blade loading mechanism. The carrier is operable to hold a plurality of blades. The carrier is selectively disposable within the carrier cavity of the housing. The blade eject assembly includes a button biased in a normal position relative to a base. The button is operable to be moved relative to the base and engage a blade disposed within the carrier, and to move the blade to a position where at least a part of the blade is disposed outside the housing.

Additionally or alternatively, the present blade dispenser may include one or more of the following features individually or in combination:

a) the housing may include at least one carrier button operable to engage the carrier disposed within the carrier cavity to selectively secure the carrier within the carrier cavity;

b) the blade eject assembly may be selectively positionable relative to the housing in an open position and in a closed position, and one or both of the housing and the blade eject assembly may include a latch to hold the blade eject assembly relative to the housing;

c) the blade eject assembly may be pivotally mounted to the housing;

d) the housing may include at least one blade eject assembly button, which button includes a latch to engage the blade eject assembly to secure the blade eject assembly relative to the housing;

e) the carrier has a length and may include a base panel having a lengthwise extending slot, and a dog operable to be selectively positioned at lengthwise positions within the carrier, and a detent mechanism operable to positionally secure the dog at lengthwise positions of the carrier;

f) the carrier may include one or more panels that define a blade cavity sized to contain a plurality of blades, which blade cavity has a cross-sectional geometry that accommodates the blades held within the carrier;

g) the carrier may include a front panel configured to receive a portion of the blade eject assembly button; and h) the blade loading mechanism may include a sled, a flexible member, a pivotable member, and a biasing element, wherein the sled is configured for travel along a lengthwise extending slot disposed in a floor panel of the housing.

The present method and advantages associated therewith will become more readily apparent in view of the detailed description provided below, including the accompanying drawings.

DETAILED DESCRIPTION OF EMBODIMENTS OF THE INVENTION

Figure 1:
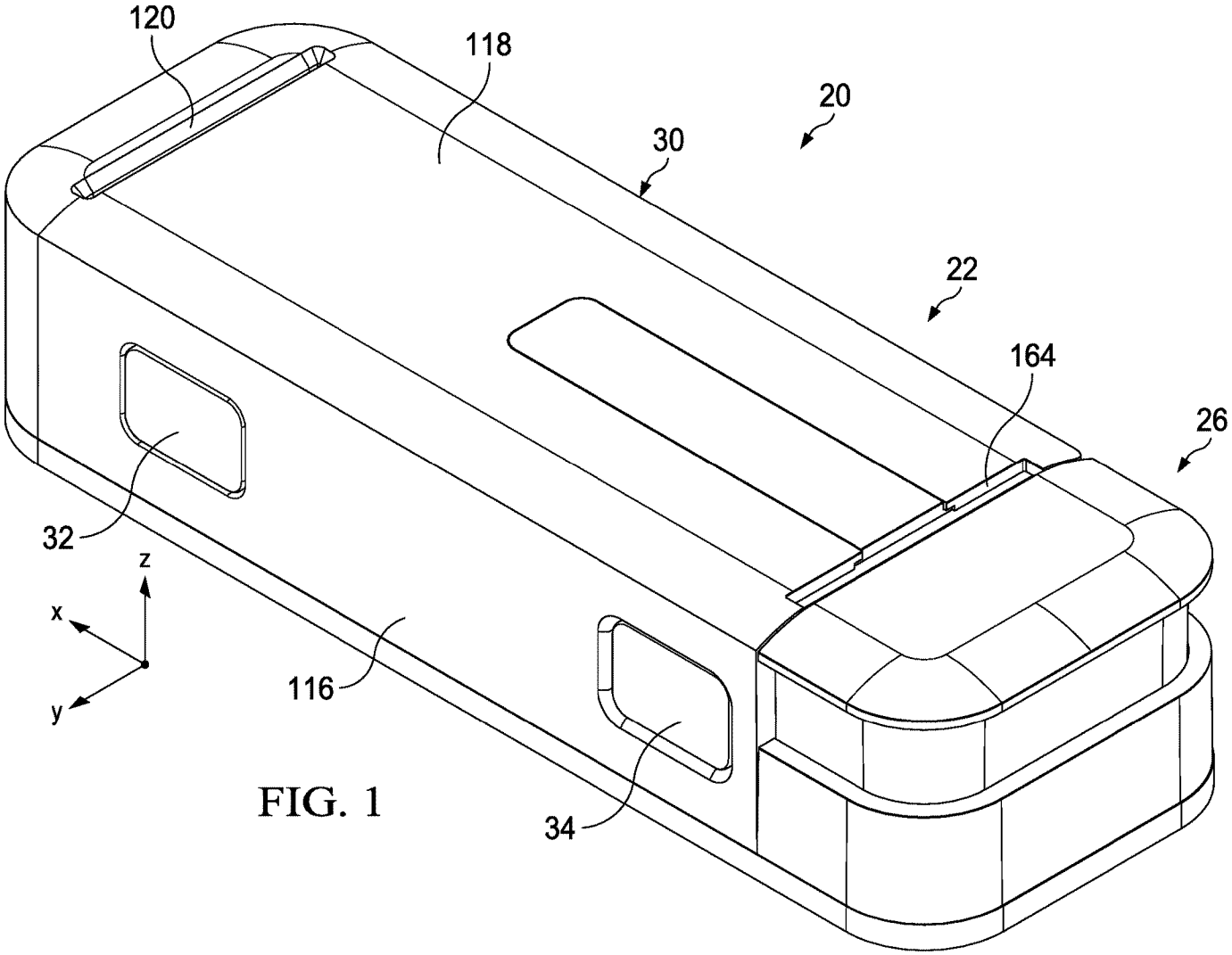
FIG. 1 is a diagrammatic isometric view of a blade dispenser embodiment.
Figure 2:
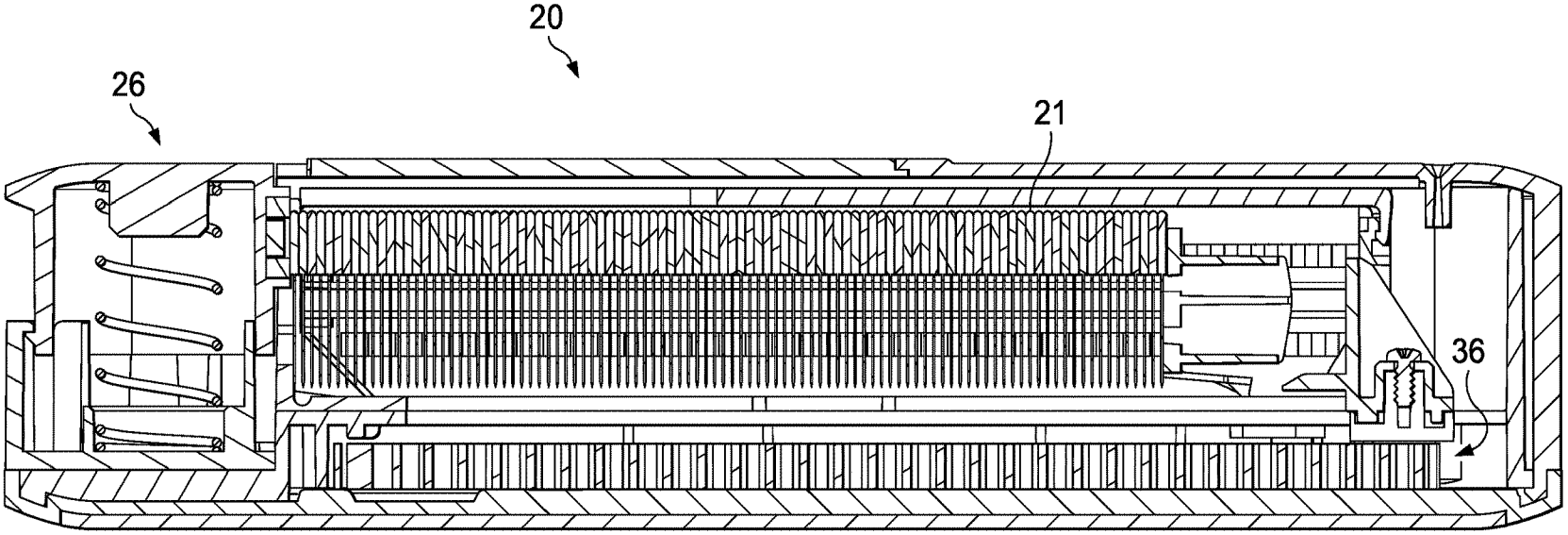
FIG. 2 is a diagrammatic cross-sectional view of the blade dispenser.
Figure 3:
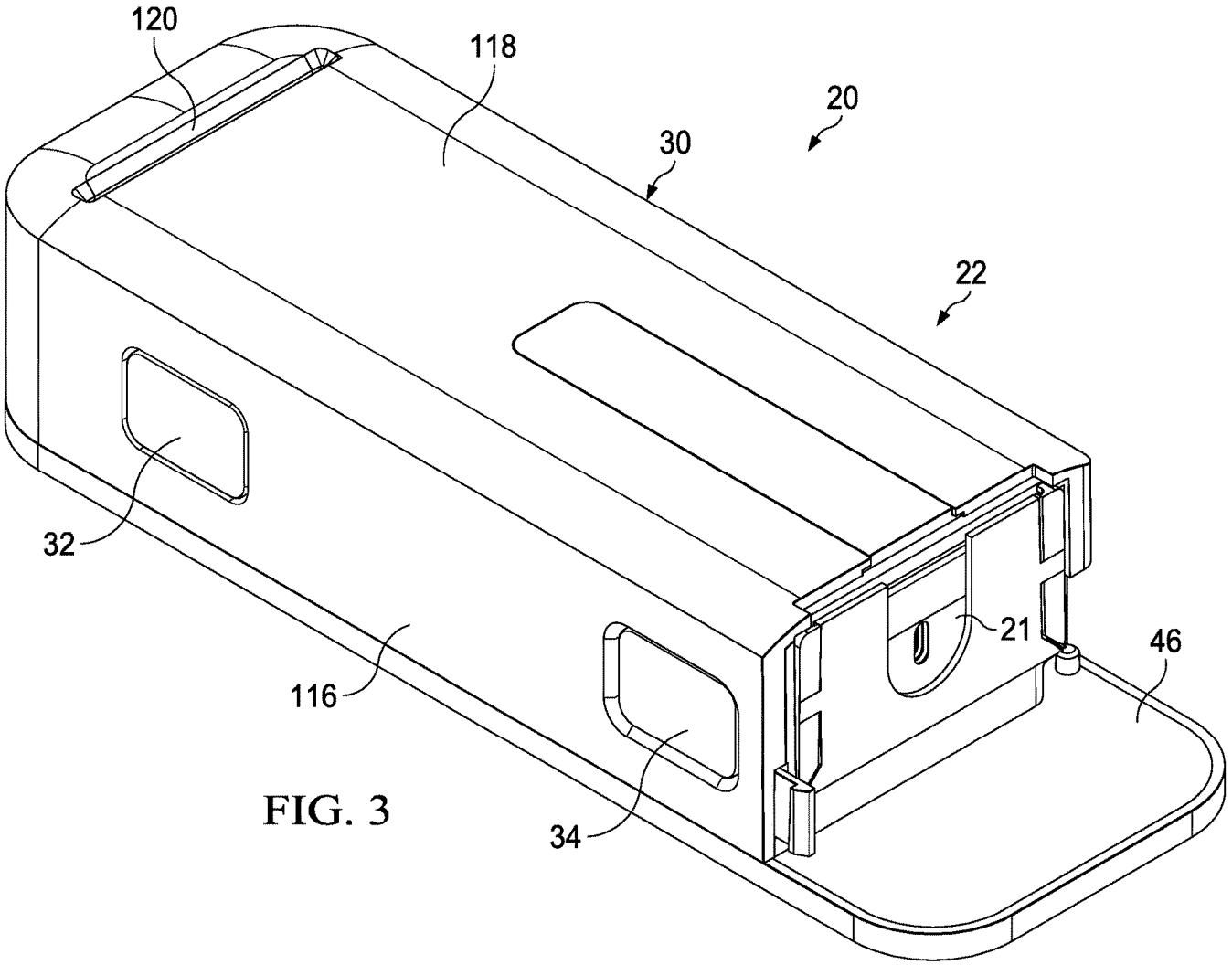
FIG. 3 is a diagrammatic isometric view of the blade dispenser with the blade eject assembly removed.

Referring to FIGS. 1-3, a blade dispenser 20 (for dispensing individual blades 21) is provided that includes a housing 22, a blade carrier 24, and a blade eject assembly 26. The housing 22 includes a base 28, a cap 30, at least one carrier button 32, a blade eject assembly latch button 34, and a blade loading mechanism 36.

Figure 4:
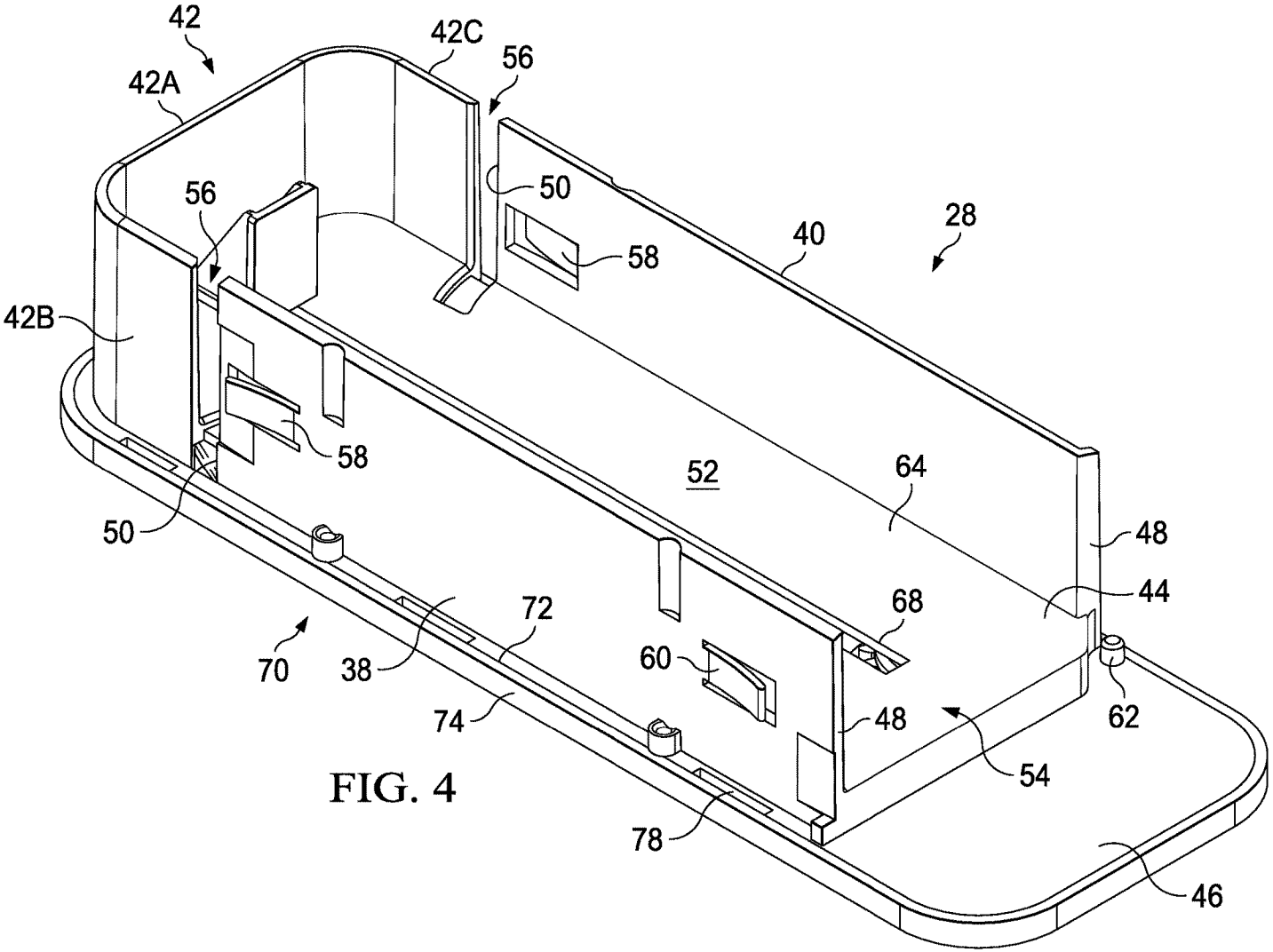
FIG. 4 is a diagrammatic isometric view of the housing base.

Now referring to FIG. 4, the base 28 includes a first side wall panel 38, a second side wall panel 40, an end wall panel 42, a floor panel 44, and a front flange 46. Each side wall panel 38, 40 extends lengthwise between an opening edge 48 and an interior edge 50. As used herein, the terms "lengthwise", "widthwise", and "heightwise" refer to, respectively, directions along the x-axis, y-axis, and z-axis; e.g., see orthogonal axes disposed adjacent FIG. 1. The interior edges 50 of each side wall panel 38, 40 are disposed proximate the end wall panel 42. The side wall panels 38, 40 and the end wall panel 42 extend outwardly from the floor panel 44, and define a slot-shaped carrier cavity 52 with an open end 54. In the embodiment shown in FIG. 4, each side wall panel 38, 40 is configured as a single panel that extends lengthwise substantially the length of the floor panel 44, and the end wall panel 42 includes a widthwise extending portion 42A, and two lengthwise extending portions 42B, 42C. In this configuration the end wall panel 42 extends substantially between the interior edges 50 of the side wall panels 38, 40, separated from the interior edges 50 on each side by a slot 56. The housing base 28 is not limited to this particular embodiment and may include other configurations that define the slot-shaped carrier cavity 52. For example, each side wall panel 38, 40 may include a plurality of wall sections generally coplanar with one another, and the end wall panel 42 may extend less than substantially between the side wall panels 38, 40, or may not be included at all.

The first side wall panel 38 includes a carrier button biasing mechanism 58 and a blade eject assembly latch button biasing mechanism 60, and the second side wall panel 40 includes a carrier button biasing mechanism 58. In the embodiment shown in FIG. 4, the carrier button biasing mechanisms 58 and the blade eject assembly latch button biasing mechanism 60 are shown as outwardly extending cantilever tabs that are engaged by buttons as will be described below. The carrier button biasing mechanisms 58 and the blade eject assembly latch button biasing mechanism 60 are not limited to a cantilever embodiment. In addition, one or more than two carrier button biasing mechanisms 58 may be used; e.g., if one or more carrier buttons 32 are used as will be described below.

The front flange 46 extends outwardly from the floor panel 44, proximate the open end 54 of the carrier cavity 52. A blade eject assembly pivot post 62 is fixed to the front flange 46, adjacent the opening edge 48 of the second side wall panel 40.

Figure 7:
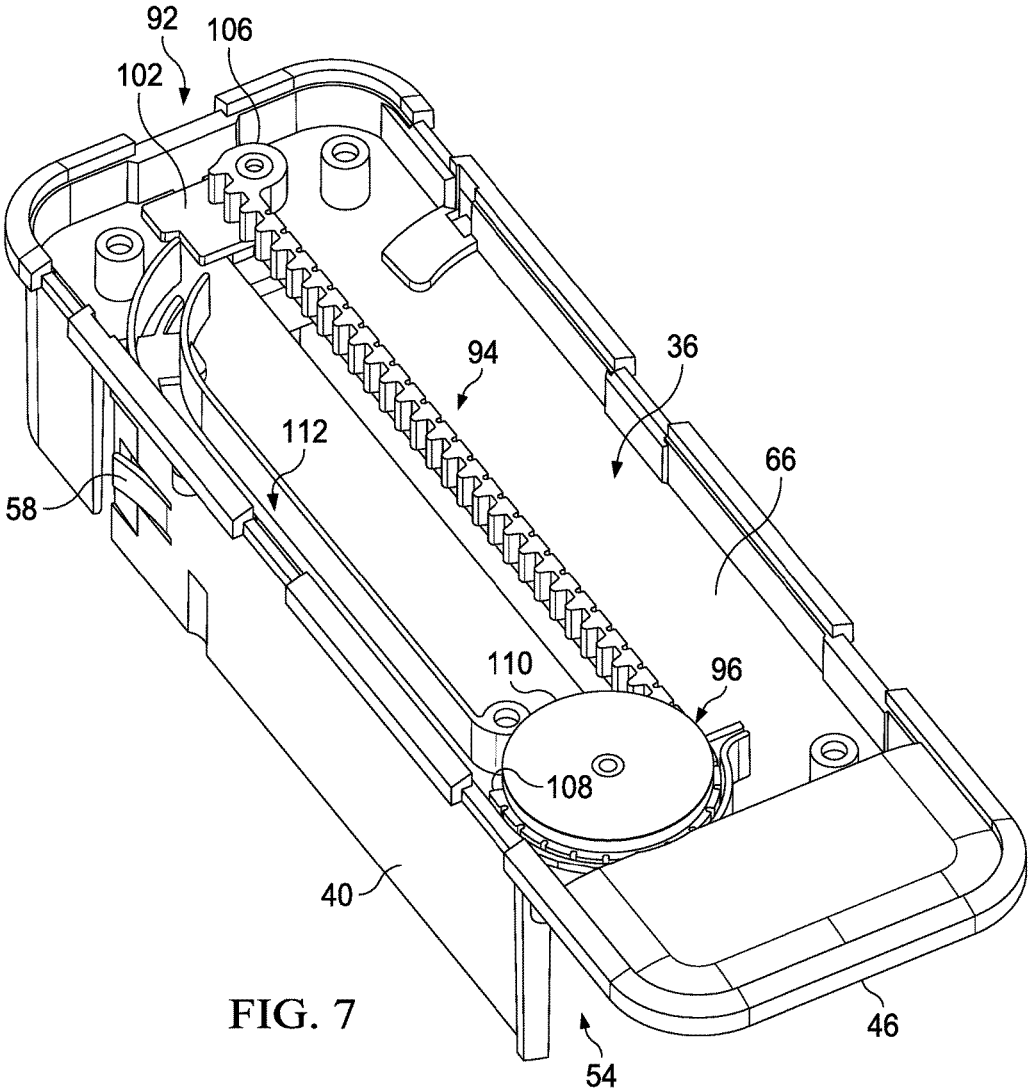
FIG. 7 is a diagrammatic isometric bottom view of the blade dispenser, illustrating aspects of the blade loading mechanism.
Figure 8A:
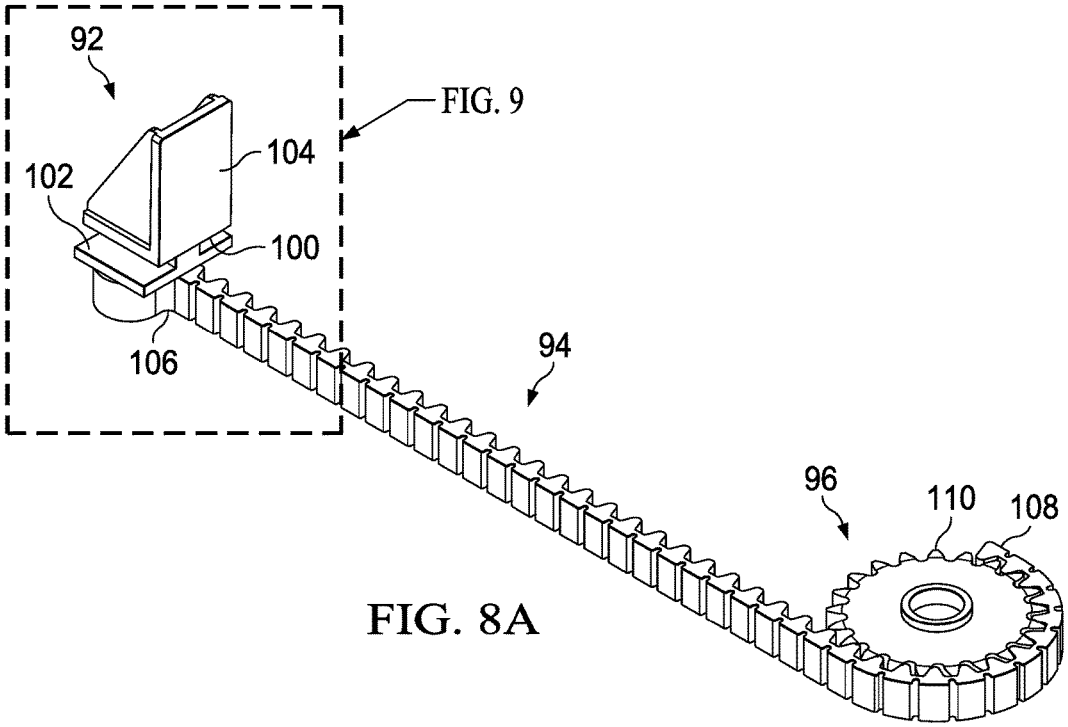
FIGS. 8A and 8B are view of elements of the blade loading mechanism.
Figure 8B:
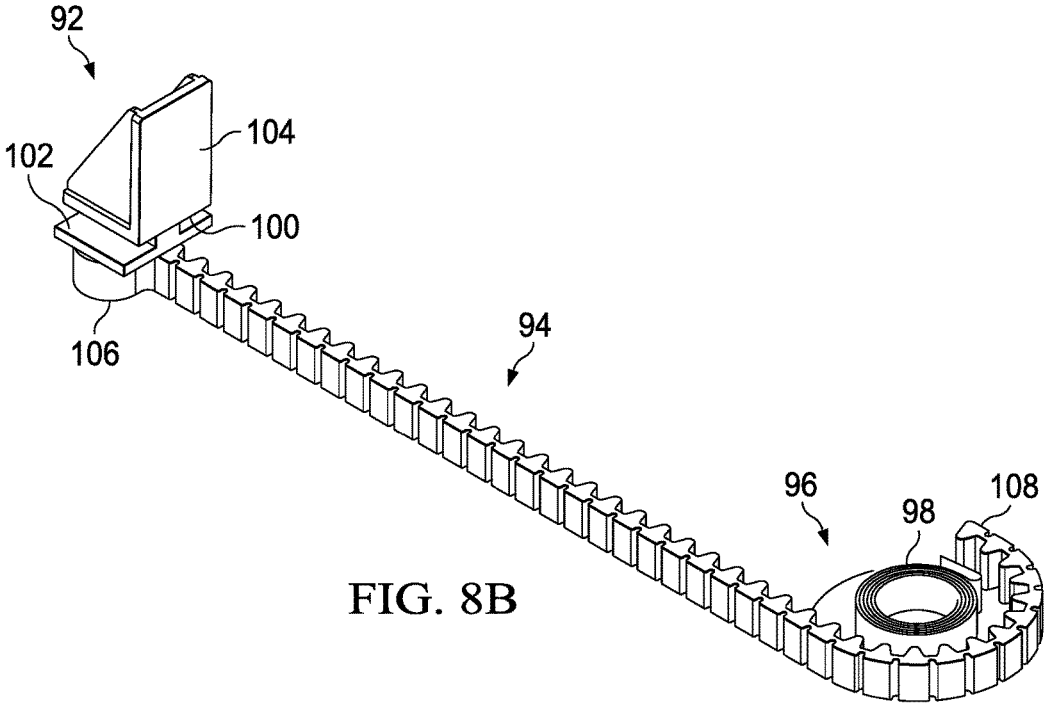
Figure 9:
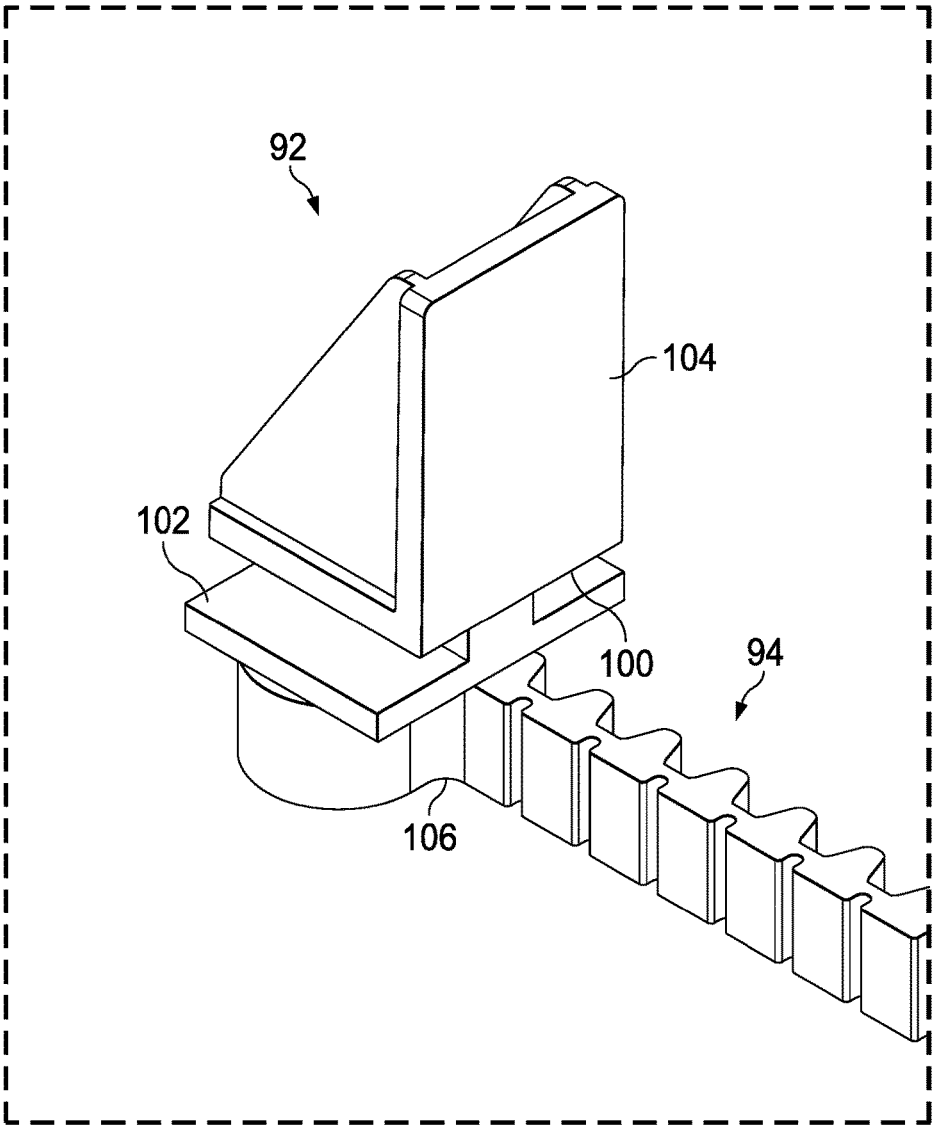
FIG. 9 is an enlarged view of the blade loading mechanism sled.

The floor panel 44 includes a carrier surface 64 and a bottom surface 66 (see FIG. 7), which bottom surface 66 is disposed opposite the carrier surface 64. A slot 68 extends through the floor panel 44 between the carrier surface 64 and the bottom surface 66. The slot 68 has a width and a length. In some embodiments, a cap ledge 70 extends around the outer periphery of the floor panel 44, including a first portion 72 that extends away from the wall panels 38, 40, and a second portion 74 that extends away from the floor panel bottom surface 66. The second portion 74 of the cap ledge 70 and the floor panel bottom surface 66 define a mechanism cavity 76 there between. A plurality of slots 78 is disposed in the first portion of the cap ledge 70. The slots 78 are configured to receive tabs extending out from the cap 30 as will be explained below.

Figure 5A:
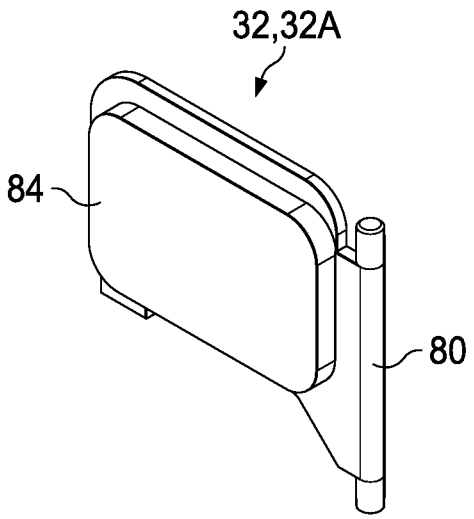
FIGS. 5A and 5B are diagrammatic isometric views of the carrier buttons.
Figure 5B:
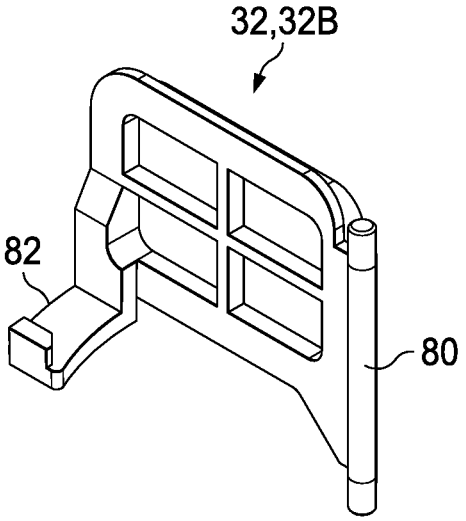
Figure 10:
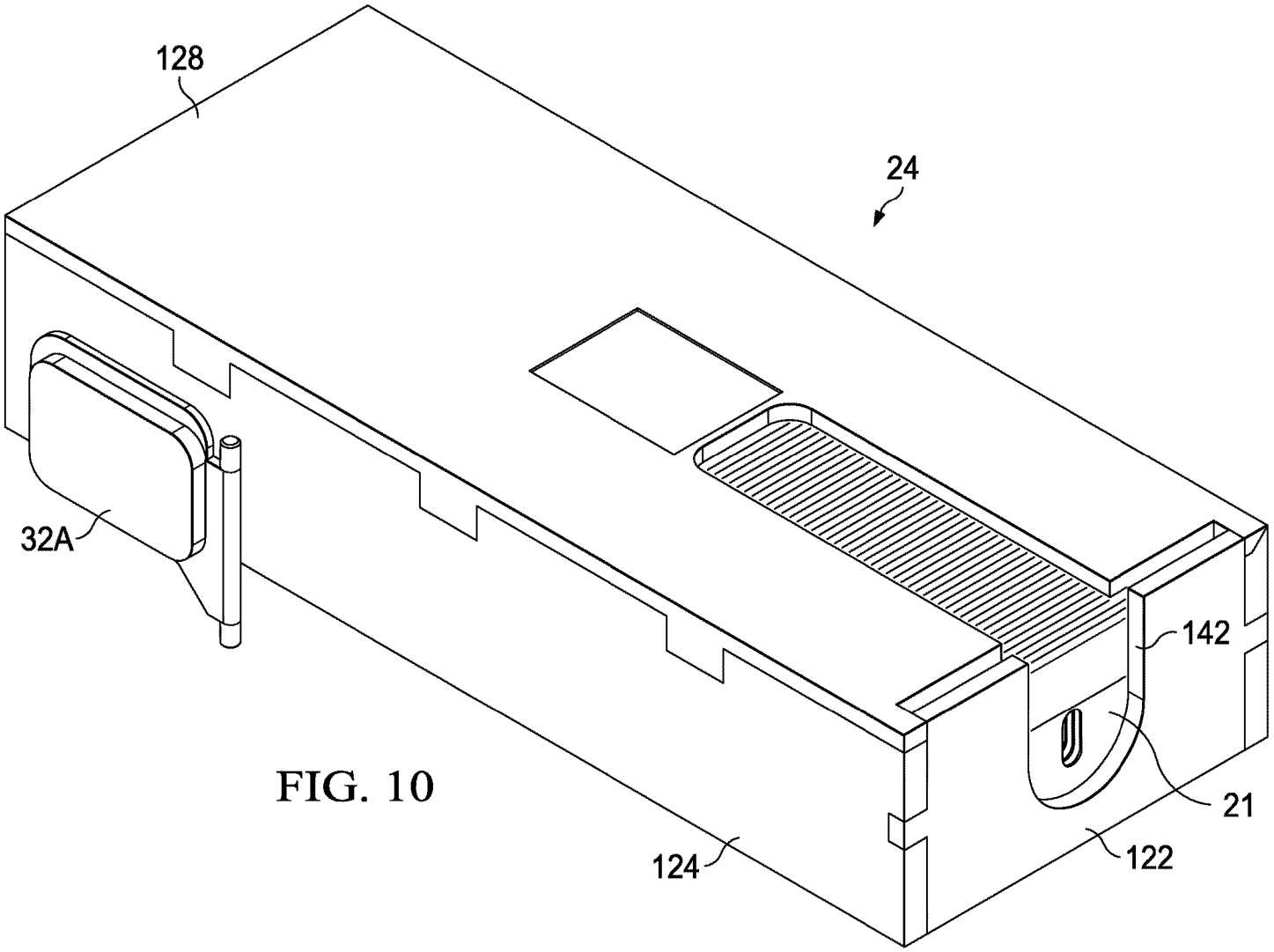
FIG. 10 is a diagrammatic isometric view of the carrier with the carrier buttons positioned aside.
Figure 11:
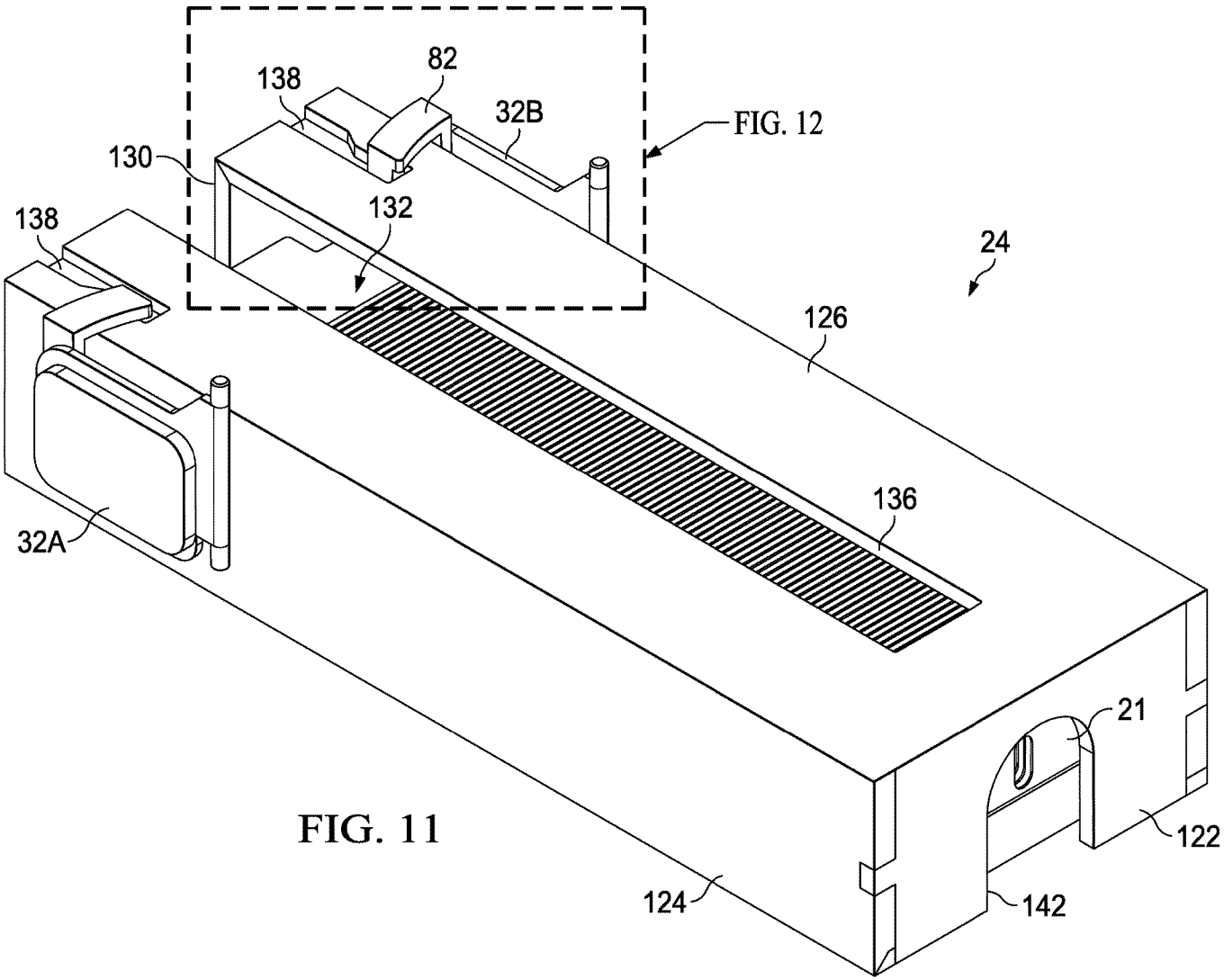
FIG. 11 is a diagrammatic isometric bottom view of the carrier with the carrier buttons positioned aside.
Figure 12:
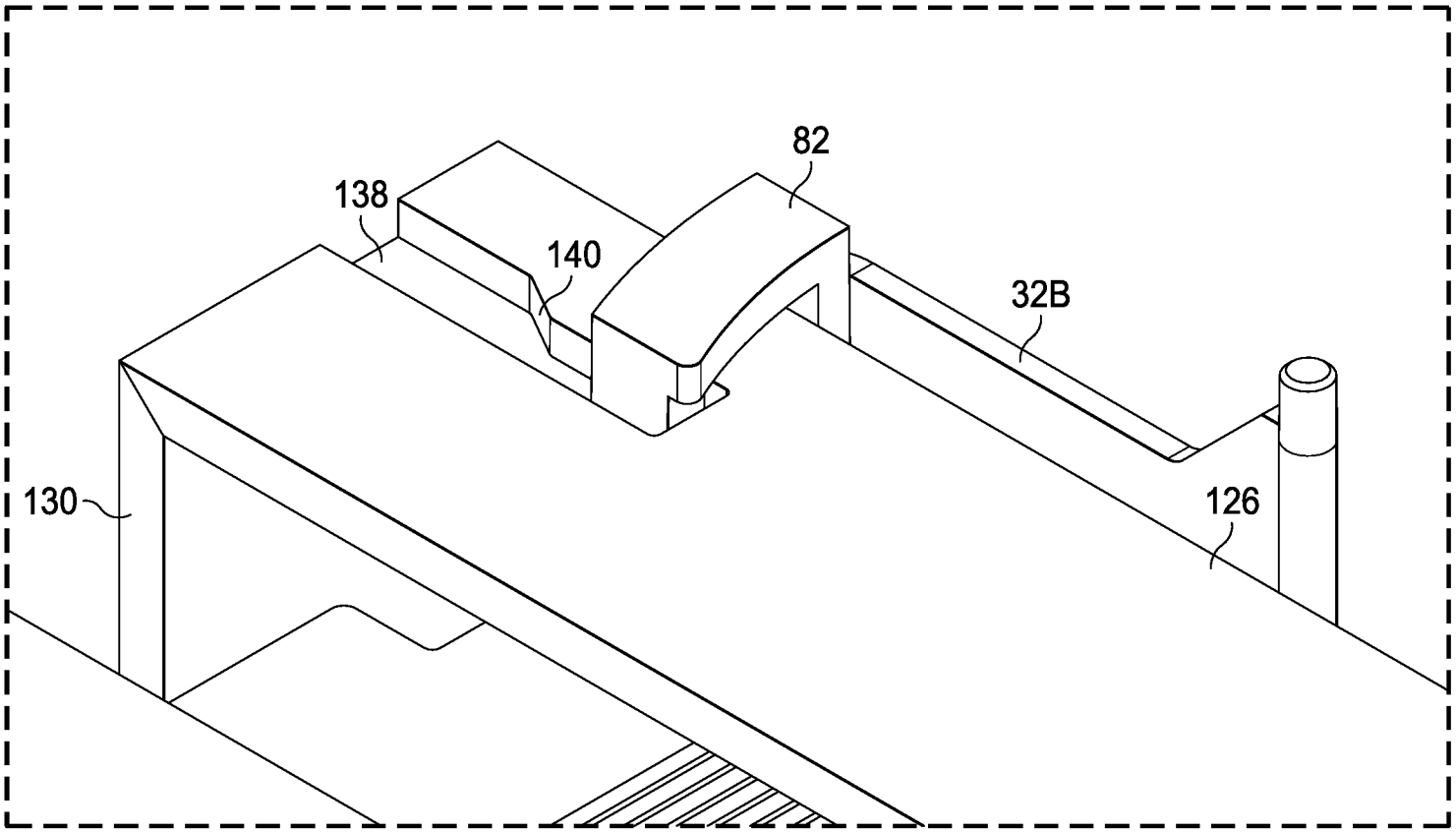
FIG. 12 is an enlarged view of a carrier button engaged with the carrier.
Figure 13:
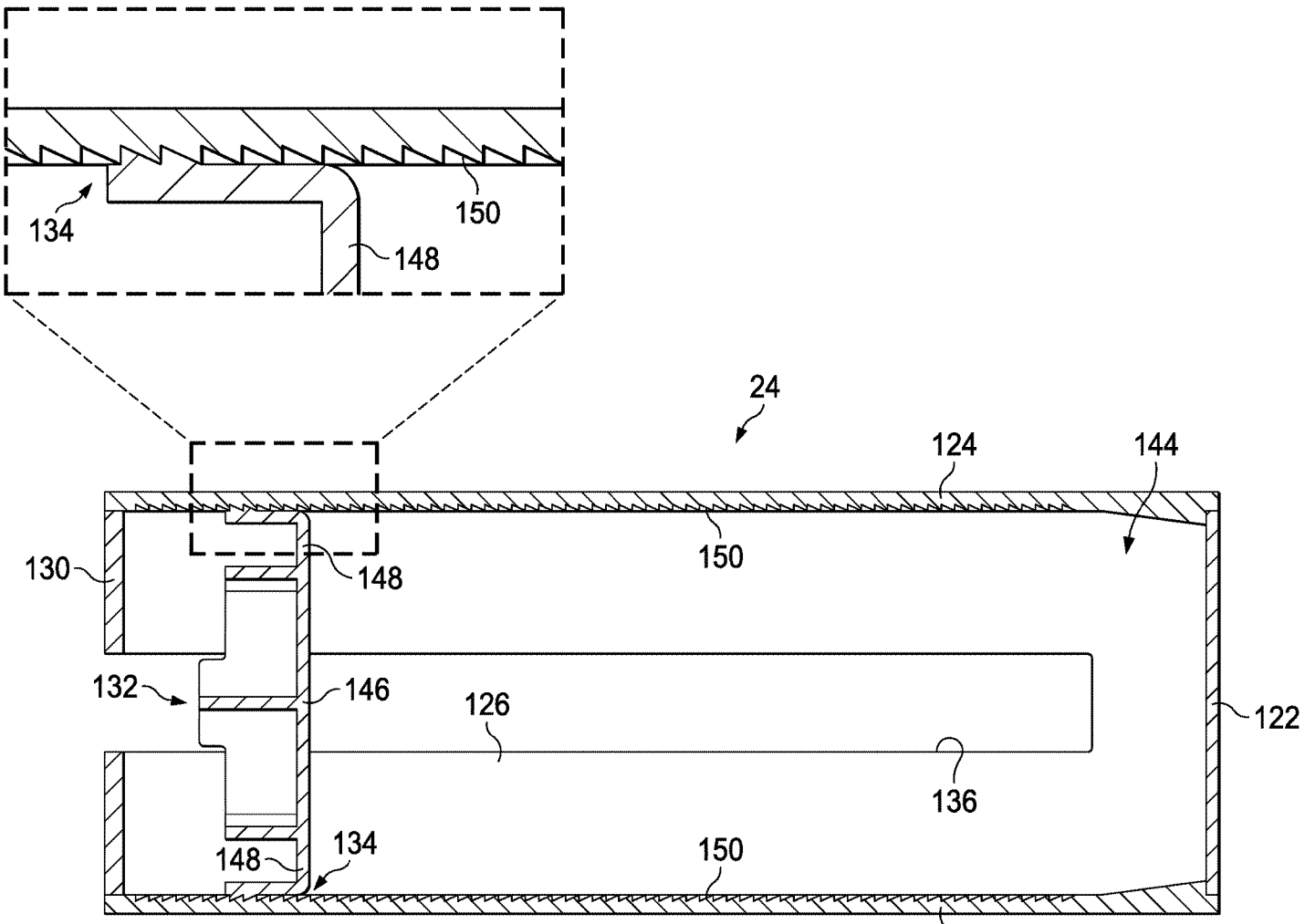
FIG. 13 is a diagrammatic top view of the carrier without the top, including an enlarged partial view of the detent mechanism.

Now referring to FIGS. 5A and 5B, in those embodiments that use a pair of carrier buttons 32 (e.g., as shown in FIGS. 10 and 11), the pair includes a first carrier button 32A and a second carrier button 32B that are mirror versions (i.e., left and right hand) of the same structure. Since the buttons 32A, 32B share the same features (albeit left and right hand configurations), only one button is described hereinafter. The button 32 includes a pivot axle 80, a latch 82, and a contact surface 84 disposed between a first end and a second end. The pivot axle 80 is disposed proximate the first end of the button 32 and the latch 82 extends outwardly from the second end of the button 32. The latch 82 is configured to engage the carrier 24 as will be described below. The first carrier button 32A is pivotally mounted to the cap ledge 70 adjacent the first side wall panel 38 (see FIGS. 10 and 11), and the second carrier button 32B is pivotally mounted to the cap ledge 70 adjacent the second side wall panel 40. The present blade dispenser 20 is not limited to this particular carrier button 32 embodiment. In addition as indicated above, one or more than two carrier buttons 32 may be used.

Figure 6:
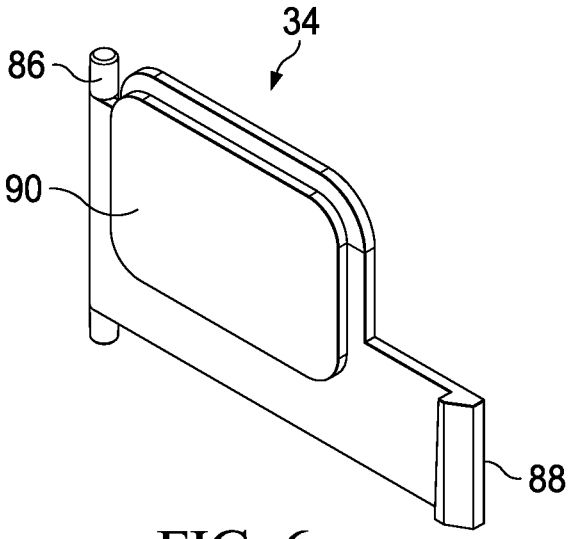
FIG. 6 is a diagrammatic isometric view of the blade eject assembly latch button.

Now referring to FIG. 6, the blade eject assembly latch button 34 includes a pivot axle 86, a latch 88, and a contact surface 90 disposed between a first end and a second end. The pivot axle 86 is disposed proximate the first end of the button 34 and the latch 88 extends outwardly from the second end of the button 34. The latch 88 is configured to engage the blade eject assembly 26 as will be described below. The blade eject assembly latch button 34 is pivotally mounted to the cap ledge 70 adjacent the first side wall panel 38.

Now referring to FIGS. 7, 8A, 8B, and 9, the blade loading mechanism 36 includes a sled 92, a flexible member 94, a pivotable member 96 (e.g., a pulley, a sprocket, etc.), and a biasing element 98. The sled 92 includes a slot member 100 extending between a bottom surface flange 102 and a blade flange 104. The slot member 100 has a width that is less than the width of the floor panel slot 68. The blade flange 104 and the bottom surface flange 102 each have a width that is greater that the width of the floor panel slot 68. The relative widths allow the sled slot member 100 to be received within the floor panel slot 68 and to slidably travel lengthwise within the floor panel slot 68, and the widths of the blade flange 104 and the bottom surface flange 102 prevent the sled 92 from passing through the floor panel 44. The flexible member 94 has a first end 106 and a second end 108. The flexible member 94 may be in the form of a linked element construction (e.g., the linked teeth construction shown in FIGS. 7, 8A, and 8B, a chain type structure, etc.) or a uniform cross-section profile configuration (e.g., a cable, a wire, a cord, a string, etc.) or other type flexible member, or combinations thereof. The pivotable member 96, which has a circumferential face 110, is mounted to the floor panel bottom surface 66 for pivotable movement around a pivot axis. The circumferential face 110 of the pivotable member 96 is configured to retain the flexible member 94 around at least a portion of the circumferential face 110. For example, in those embodiments where the flexible member 94 has a linked element construction (e.g., the teeth shown in FIGS. 7 and 8A), the circumferential face 110 may include teeth (e.g., a sprocket) that mesh with the linked element construction. Alternatively if the flexible member 94 has a uniform cross-section configuration, the circumferential face 110 may be configured (e.g., a pulley) to receive the flexible member 94. The circumferential face 110 is not limited to any particular configuration. In some embodiments, the blade loading mechanism 36 may include a chute 112 attached to the bottom surface of the floor panel 44 configured to receive the flexible member 94.

The blade loading mechanism 36 is arranged such that the first end 106 of the flexible member 94 is attached to the bottom surface flange 102 of the sled 92, and extends lengthwise to and around the pivotable member 96, engaging the circumferential face 110 of the pivotable member 96. In those embodiments that include a chute 112, the flexible member 94 is either aligned to enter into the chute 112 or is at least partially disposed within the chute 112. The amount of the flexible member 94 that is disposed in the chute 112 depends on the lengthwise position of the sled 92.

The blade loading mechanism biasing member 98 is operable to bias the sled 92 toward the open end 54 of the carrier cavity 52. For example, in the embodiment shown in FIG. 8B, the biasing member 98 is a torsion spring engaged with the pivotable member 96 and operable to cause the pivotable member 96 to rotate about its pivot axis. In an alternative embodiment (or in addition), a biasing member may be attached to the second end 108 of the flexible member 94 to bias the sled 92 (attached to the opposite end of the flexible member 94) toward the open end 54 of the carrier cavity 52. The blade loading mechanism 36 is not limited to these embodiments, however.

Now referring to FIGS. 1-3, the cap 30 includes one or more side panels 116 and a top panel 118, and structure for attaching the cap 30 to the base 28. The side panels 116 and top panel 118 collectively enclose the carrier cavity 52, except for the open end 54 of the carrier cavity 52 which is not enclosed. The top panel 118 may include a window to permit visual inspection of the blades 21 disposed within the carrier 24 when the carrier 24 is disposed within the carrier cavity 52 as will be described below. The structure for attaching the cap 30 to the base 28 includes a plurality of tabs (not shown) configured to engage the slots 78 disposed in the cap ledge 70. The cap 30 may alternatively be attached to the base 28 by other structure.

In some embodiments, the housing 22 may include a slot 120 (see FIGS. 1-3) for placing used blades 21 for safe storage and eventual disposal or to safely hold a blade that is in use.

Now referring to FIGS. 10-13, the carrier 24 includes a front panel 122, a pair of side panels 124, a base panel 126, a top panel 128, a back panel 130, a position adjustable dog 132, and a detent mechanism 134 operable to positionally secure the dog 132. The base panel 126 includes a lengthwise extending slot 136 having a width that is greater than the width of the sled 92 to permit the sled 92 to pass through base panel slot 136. In the embodiment shown in FIGS. 11 and 12, the base panel 126 further includes a pair of latch slots 138 which (as will be described below) are configured to engage the respective carrier button latch 82. The latch slots 138 each include a ramped tooth 140 extending into the respective slot 138. The carrier 24 is not limited to the described latch slots 138 disposed in the base panel 126. For example, a latch slot 138 may be disposed in a side panel 124, top panel 128, or base panel 126, and the latch slot 138 may assume alternative configurations operable to engage a carrier button latch 82. The front panel 122 is configured to receive structure extending out from the blade eject assembly 26 as will be described below; e.g., the carrier front panel 122 shown in FIGS. 10 and 11 includes a U-shaped opening 142. The side panels 124, base panel 126, and top panel 128 extend lengthwise between the front panel 122 and the back panel 130 and define a blade cavity 144 there between. The cross-sectional geometry of the blade cavity 144 is selected to accommodate the blades 21 stored within the carrier 24; e.g., the carrier 24 shown in FIGS. 10, 11, and 13 has a rectangular cross-section blade cavity 144 which accommodates the rectangular shape of the blades 21. The carrier 24 is not limited to a rectangular cross-section configuration. The top panel 128 is selectively removable to permit blades 21 to be loaded into the blade cavity 144. The top panel 128 may include a window to permit visual inspection of the blades 21 disposed within the carrier 24. The top panel 128 is configured to include a cutout 141 disposed at the forward end of the top panel 128. The cutout 141 and the front panel 122 combine to form a slot. The slot is configured to allow the passage a razor blade there through.

The dog 132, which is disposed and adjustably positioned in the blade cavity 144, includes a blade contact face 146 that extends widthwise between the side panels 124. A pair of cantilevered arms 148 with teeth is attached to the dog 132. The cantilevered arms 148 form a first portion of the detent mechanism 134 that is operable to positionally secure the dog 132. The teeth of the cantilevered arms 148 are positioned to engage mating rows of teeth 150 disposed in the carrier 24. The mating rows of teeth 150 form a second portion of the detent mechanism 134. As will be described below, the detent mechanism 134 allows the dog 132 to be moved toward the front panel 122, but inhibits movement of the dog 132 toward the back panel. The detent mechanism 134 is not limited to the described embodiment. For example, in alternative embodiments, there may be one or more than two cantilevered arm/teeth row combinations, and the teeth row(s) may be disposed elsewhere in the carrier 24.

Figure 14:
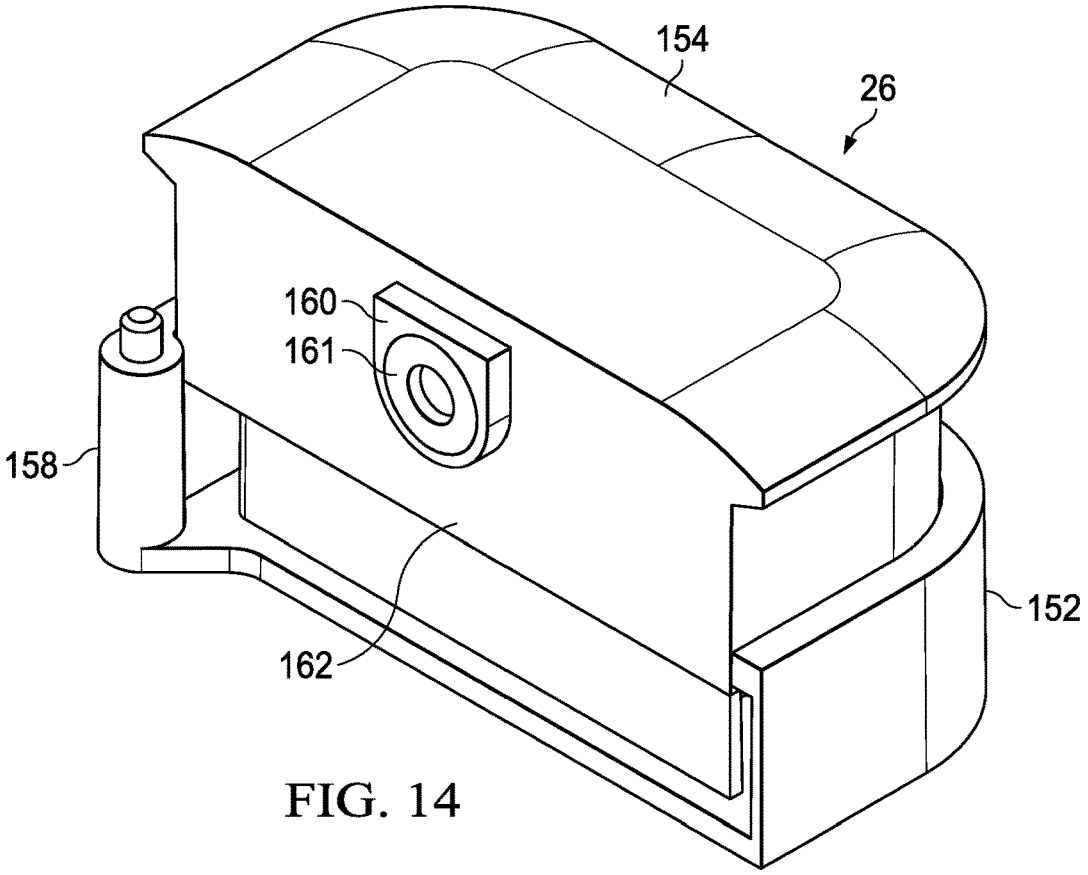
FIG. 14 is a diagrammatic isometric view of the blade eject assembly.
Figure 15:
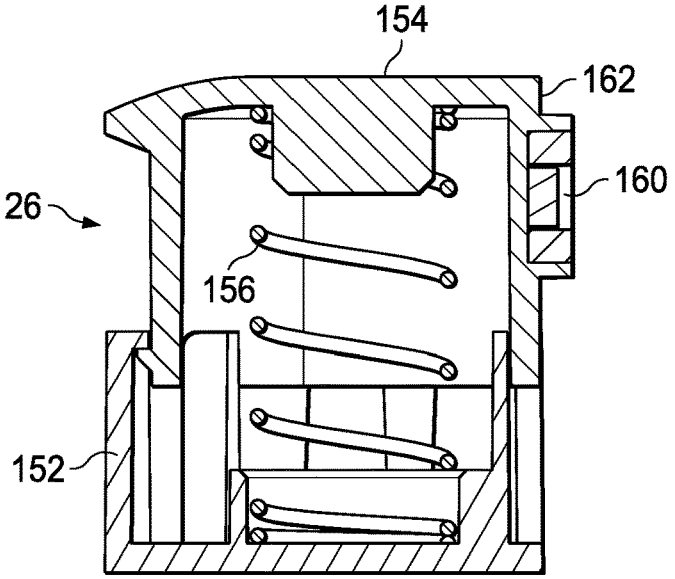
FIG. 15 is a cross-sectional view of the blade eject assembly.

Now referring to FIGS. 14 and 15, the blade eject assembly 26 includes base 152, a button 154, and a button biasing member 156. The base 152 includes a pivot member 158 disposed on a widthwise side configured to engage the blade eject assembly pivot post 62 fixed to the front flange 46. The pivot member 158 and blade eject assembly pivot post 62 cooperate to allow the blade eject assembly 26 to rotate about a pivot axis toward and away from the housing 22, and toward and away from carrier 24 when the carrier 24 is disposed in the carrier cavity 52. FIG. 14 illustrates the pivot member 158 having an additional pivot post which cooperates with the cap 30 to facilitate the aforesaid pivot motion. The male and female arrangement between the pivot posts and pivot member may be alternatively be switched between those elements. The button 154 includes a blade engagement structure 160 configured to engage a blade 21 disposed in the carrier 24 as will be described below; e.g., the engagement structure 160 can be configured to engage the edge of a protective metal cap attached to the blade 21. The blade engagement structure 160 extends outwardly from a housing side surface 162 of the button 154. In some embodiments, the blade engagement structure 160 may include a magnet 161, which magnet 161 facilitates blade handling/movement. The button 154 is configured to allow heightwise translation (e.g., vertical translation) of the button 154 relative to the assembly base 152. The button biasing member 156 (e.g., a coil spring) is disposed between an interior surface of the button 154 and an interior surface of the base 152, and biases the button 154 in a height wise direction away from the base 152. FIGS. 1 and 2 show the button 154 biased in the normal position. The button 154 and base 152 include features (e.g., tabs) that limit the relative travel there between and maintain the base 152 and button 154 coupled together. The base 152 further includes structure (e.g., a slot) for engaging the latch 88 of the blade eject assembly latch button 34. The blade eject assembly 26 is not limited to the above-described embodiment; e.g., the assembly may assume a configuration that is selectively attached to and removable from the housing 22 rather than the pivotable arrangement described above.

Figure 16:
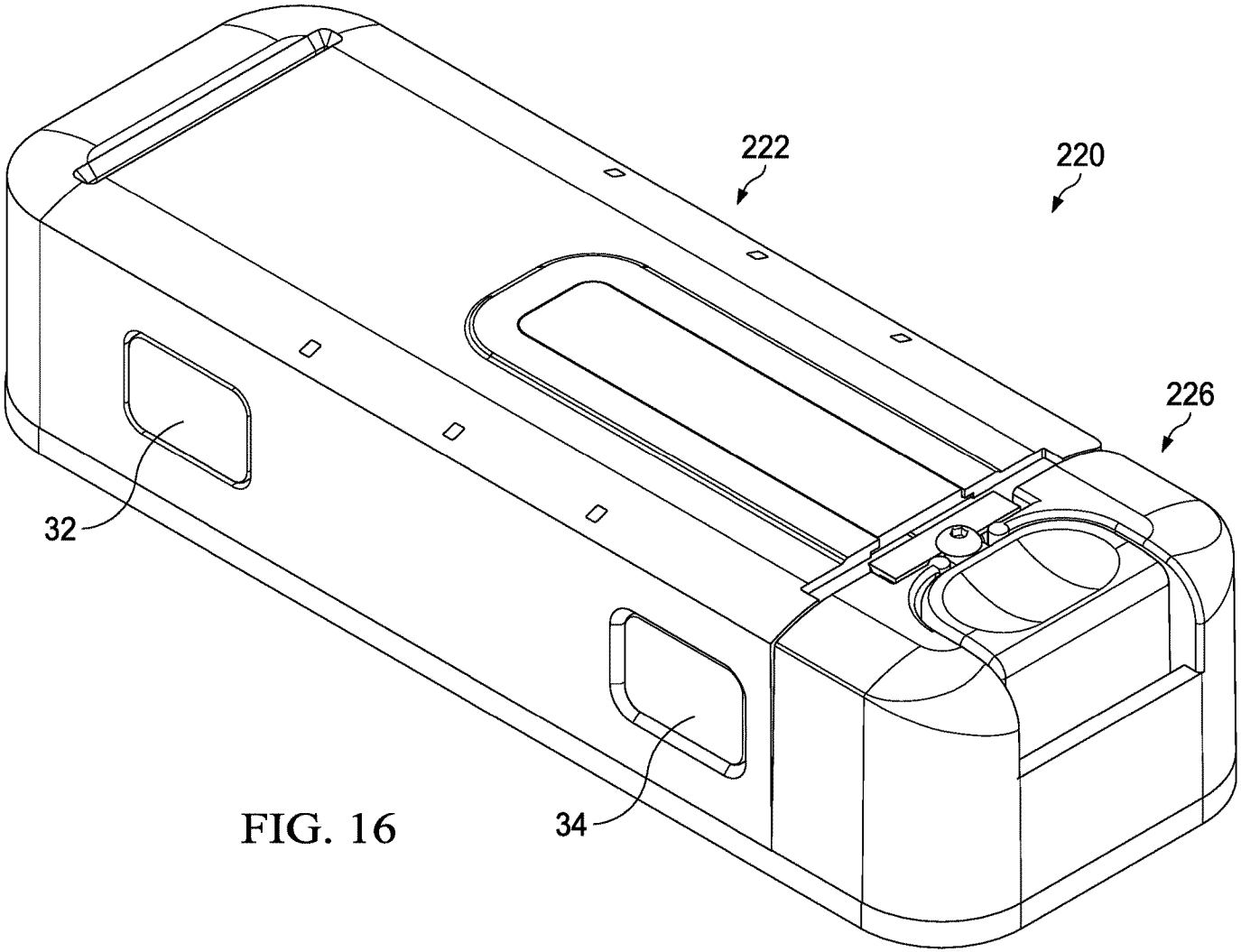
FIG. 16 is a diagrammatic isometric view of a blade dispenser embodiment, illustrating the blade eject assembly in a closed position.
Figure 17:
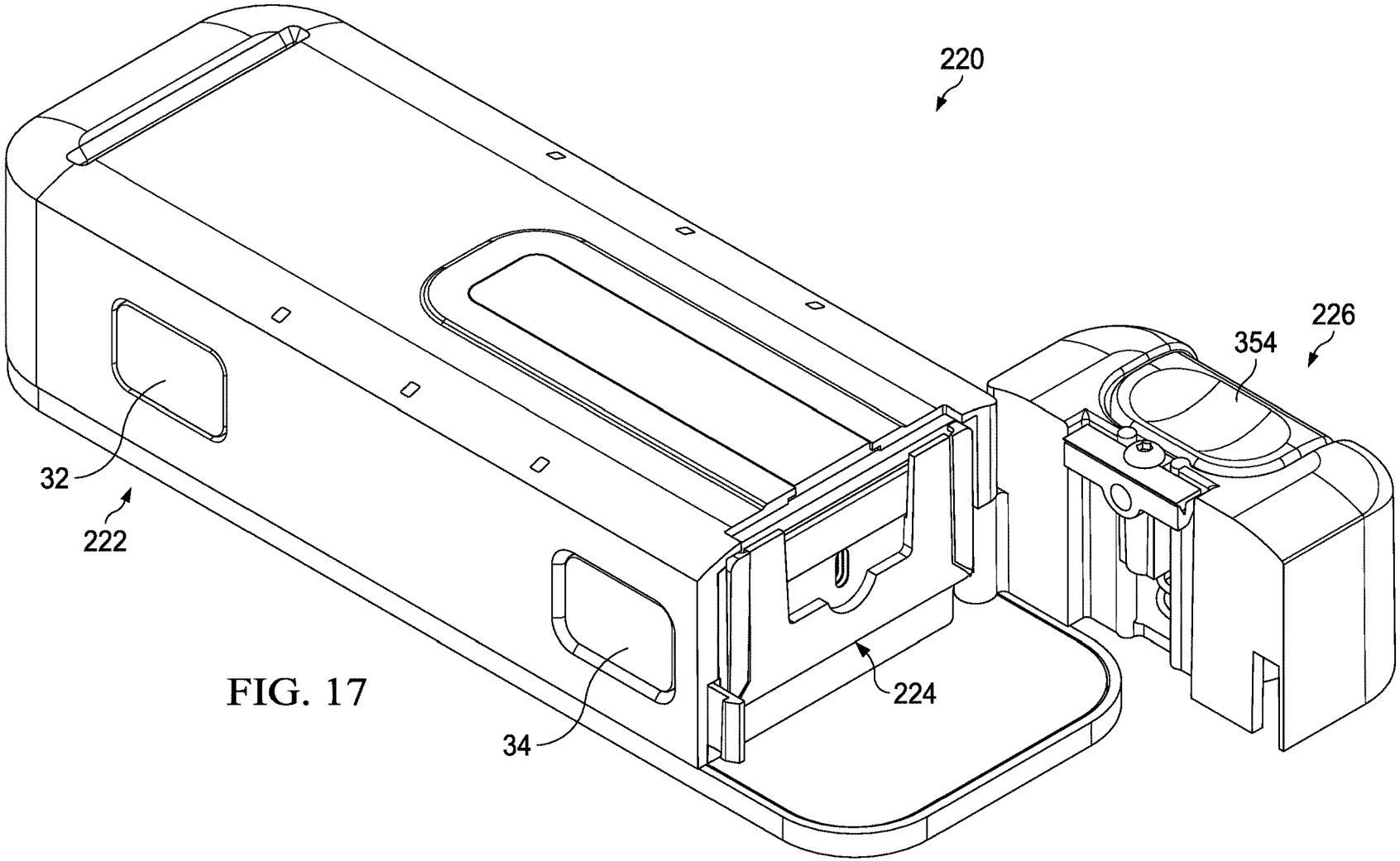
FIG. 17 is a diagrammatic isometric view of a blade dispenser embodiment, illustrating the blade eject assembly in an open position.
Figure 18:
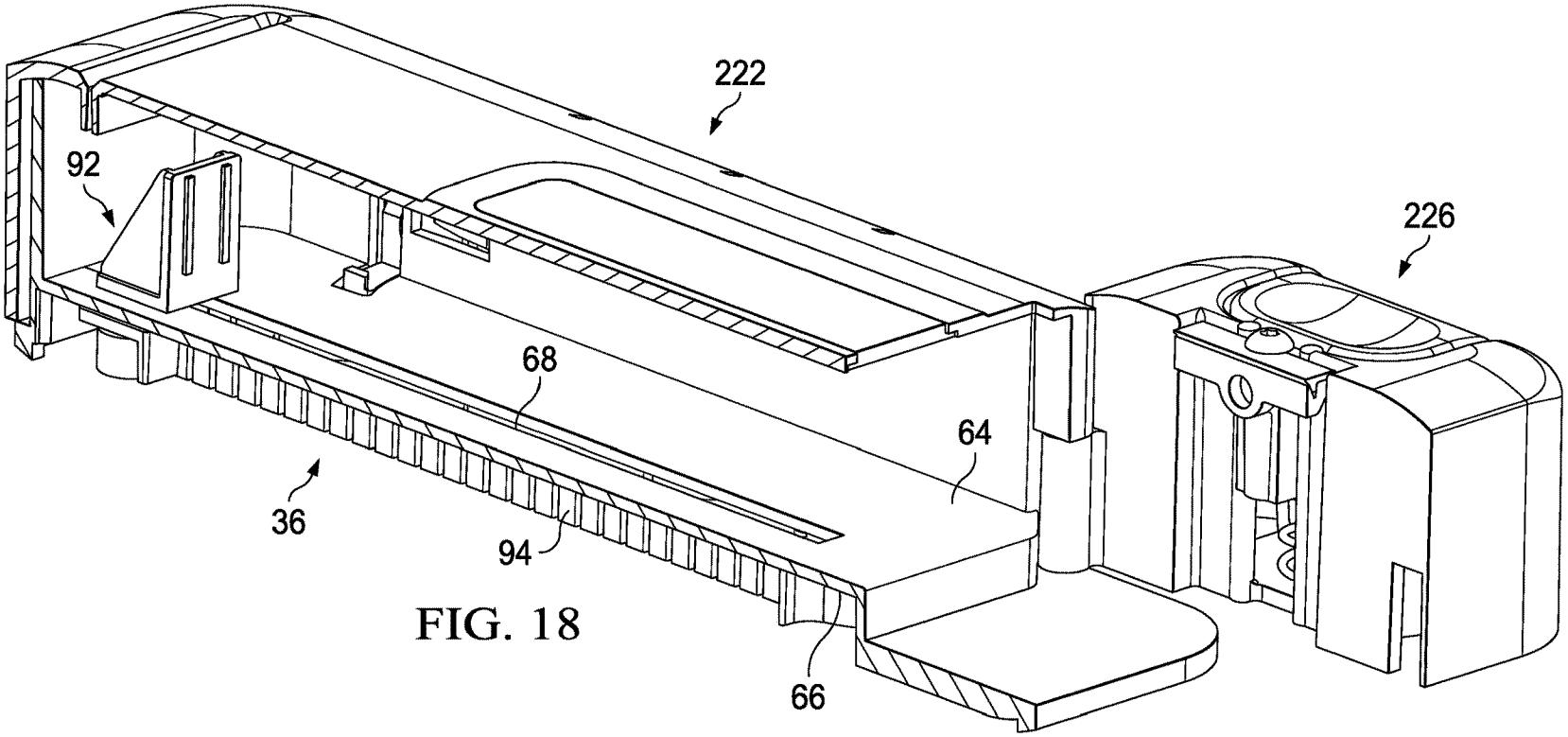
FIG. 18 is a sectional diagrammatic view of a blade dispenser embodiment, illustrating the blade eject assembly in an open position.

FIGS. 16-18 illustrate embodiments of the present disclosure. Features of the present disclosure described below may be included in any of embodiments described herein. Embodiments are described below in the context of a blade dispenser 220 (for dispensing individual blades 21) that includes a housing 222, a blade carrier 224, and a blade eject assembly 226.

Figure 23:
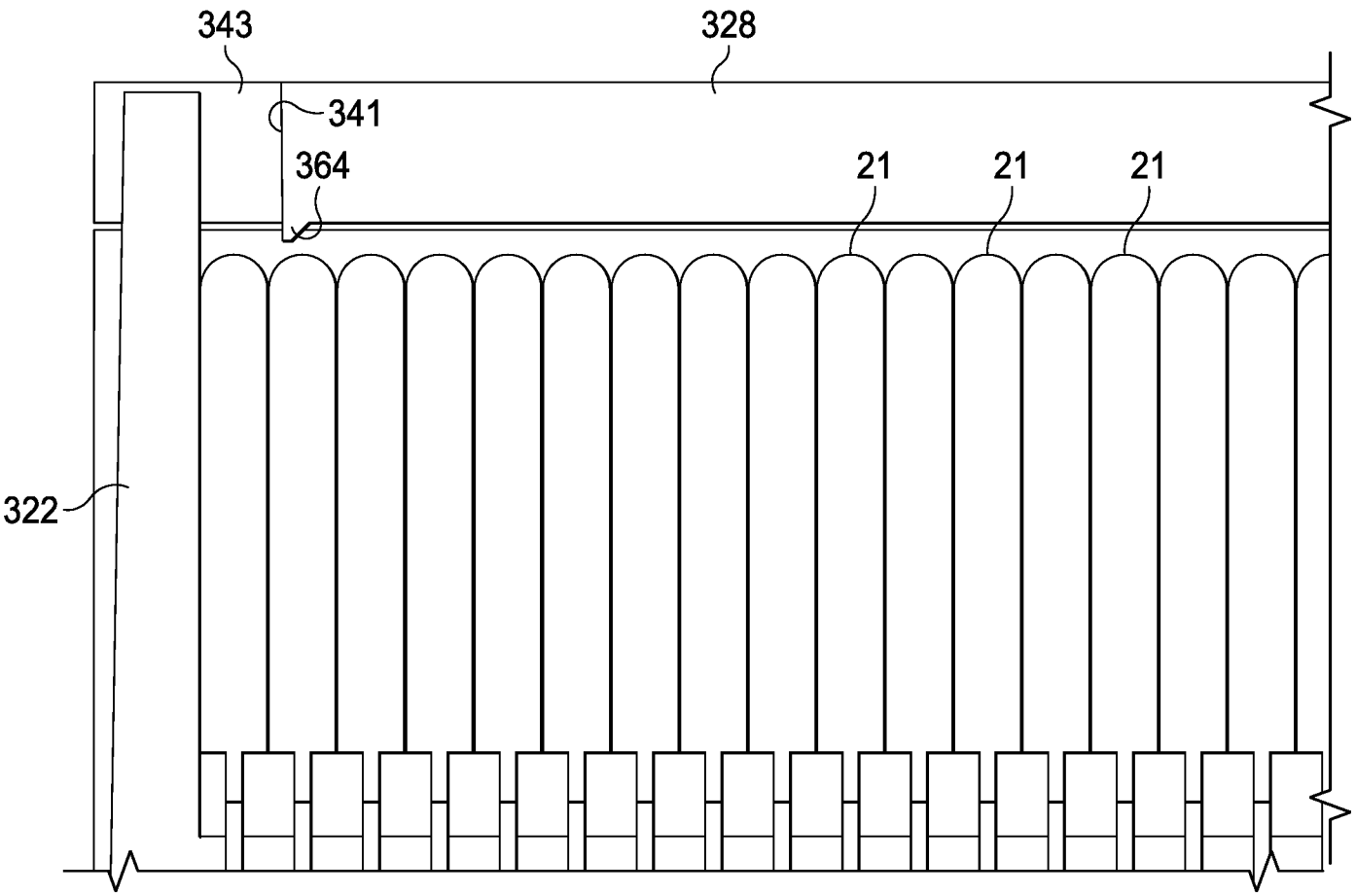
FIG. 23 is a sectional diagrammatic partial view of a blade carrier embodiment.
Figure 24:
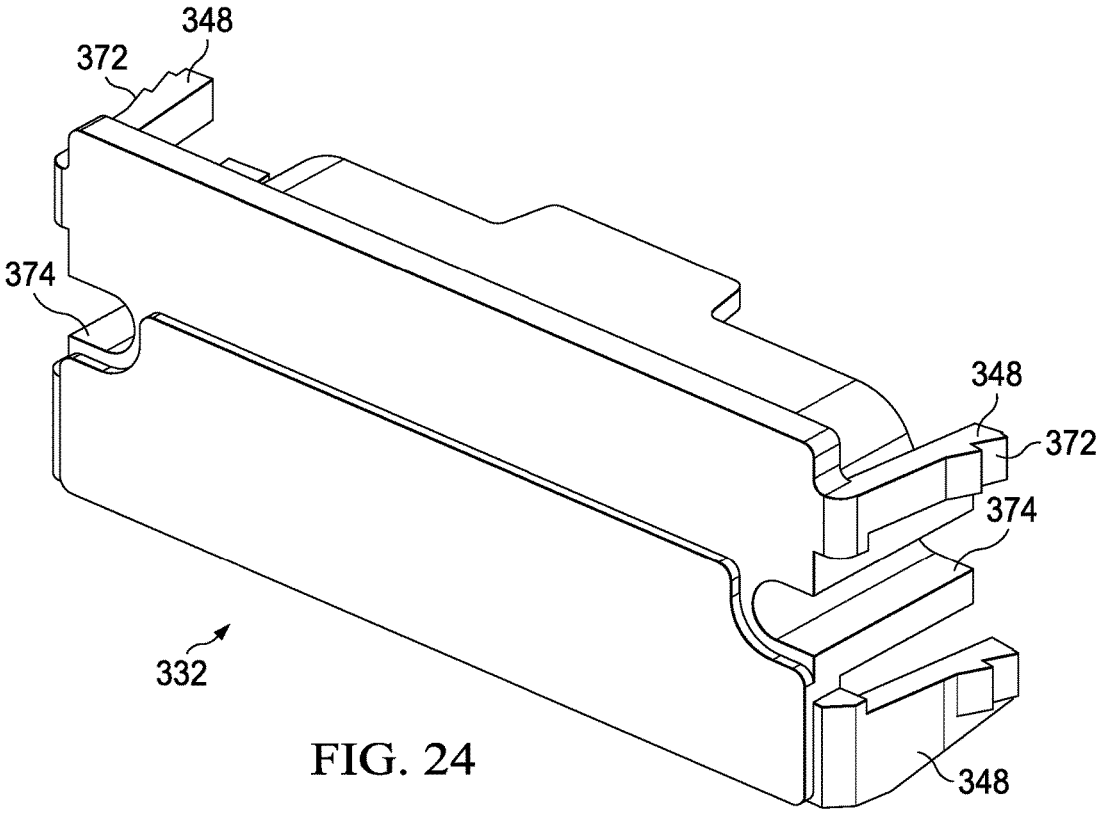
FIG. 24 is a diagrammatic isometric view of a position adjustable dog.
Figure 25:
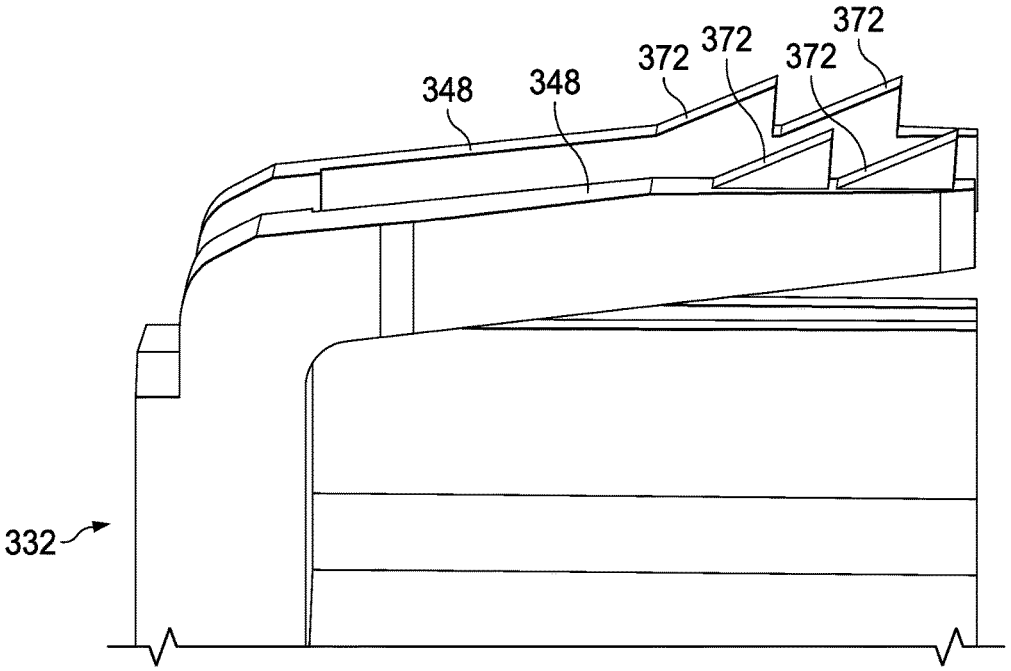
FIG. 25 is a diagrammatic sectional partial view of the position adjustable dog shown in FIG. 24.

Now referring to FIGS. 19-22, the blade carrier 224 includes a front panel 322, a pair of side panels 324, a base panel 326, a top panel 328, a back panel 330, a position adjustable dog 332 (e.g., see FIG. 20), and a detent mechanism 334 operable to positionally secure the dog 332. The base panel 326 includes a lengthwise extending slot 336 having a width that is greater than the width of the sled 92 (e.g., see FIGS. 4 and 18); e.g., to permit the sled 92 to pass through base panel slot 336. The base panel 326 may include a pair of latch slots 338 (e.g., see FIG. 21) configured to engage the respective carrier button latch 82. The front panel 322 is configured to receive structure extending out from the blade eject assembly 226 as will be described below; e.g., the carrier front panel 322 shown in FIGS. 19 and 22 includes an opening 342 configured to receive a blade engagement structure portion of a blade eject assembly button 354. The top panel 328 includes a cutout 341 disposed at the forward end of the top panel 328. The cutout 341 and the front panel 322 combine to form a slot 343 (e.g., see FIG. 23). The slot 343 is configured to allow the passage of a razor blade 21 there through. In a manner similar to the embodiments described above, the side panels 324, base panel 326, and top panel 328 extend lengthwise between the front panel 322 and the back panel 330 to define a blade cavity 144 there between.

Now referring to FIGS. 22, 23, 28A, and 28B in some embodiments the blade carrier 224 includes a one or more features disposed adjacent the front panel 322 to position the blades disposed there at. For example, the top panel 328 may include one or more tabs 364 adjacent the edge of the cutout 341 that are configured to separate the forward most razor blade 21 from the next razor blade 21 within the blade carrier 224 as the forward most razor blade is moved vertically upward as it is being dispensed from the blade carrier 224. In the embodiment shown in FIGS. 23, 28A, and 28B the tabs 364 are shaped to complement the geometry of the razor blade protective cap, but still allow forward travel of the blade 21 once the forward most blade is removed.

Figure 19:
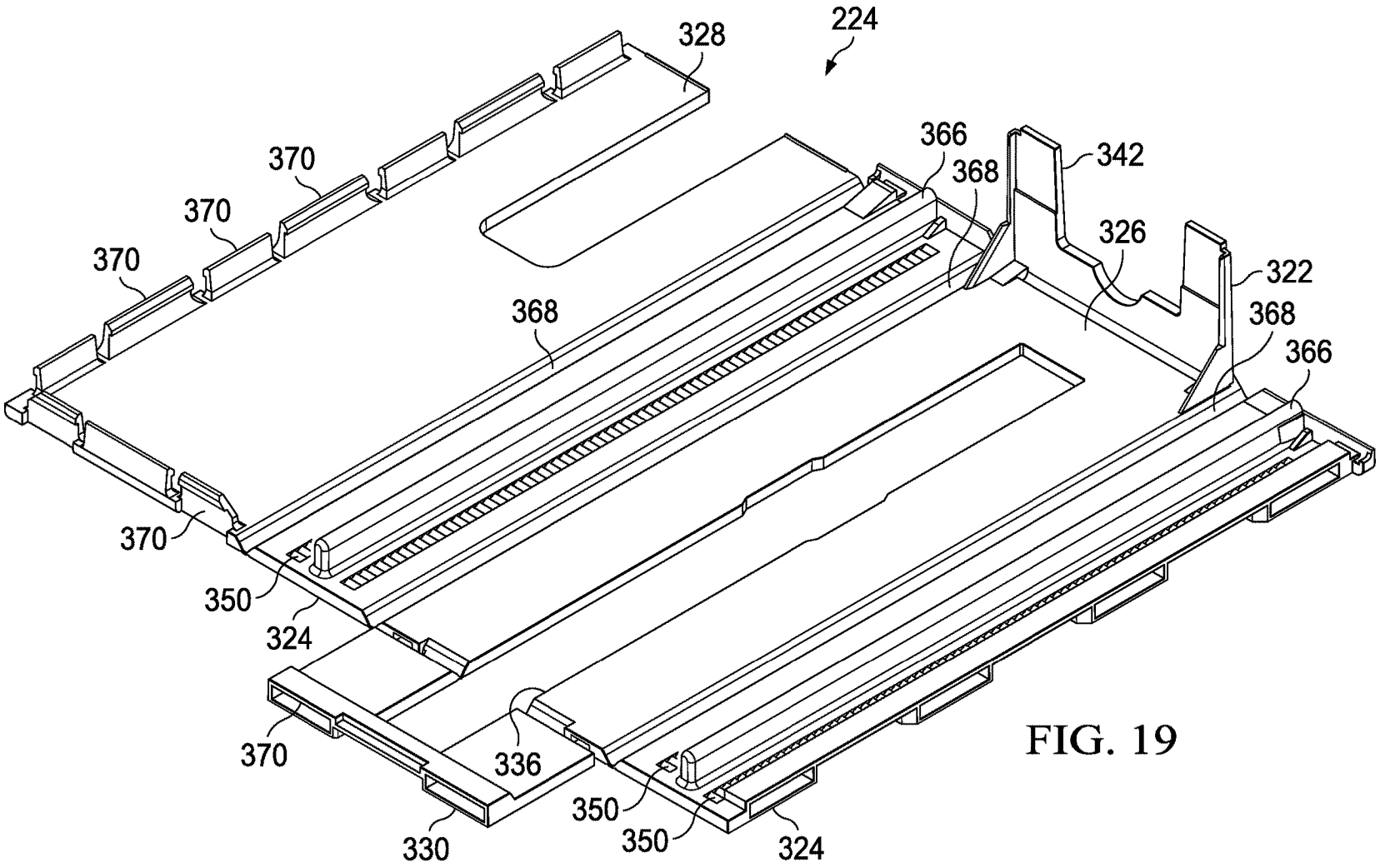
FIG. 19 is a diagrammatic view of a blade carrier embodiment having a unitary body, shown in unassembled form.
Figure 20:
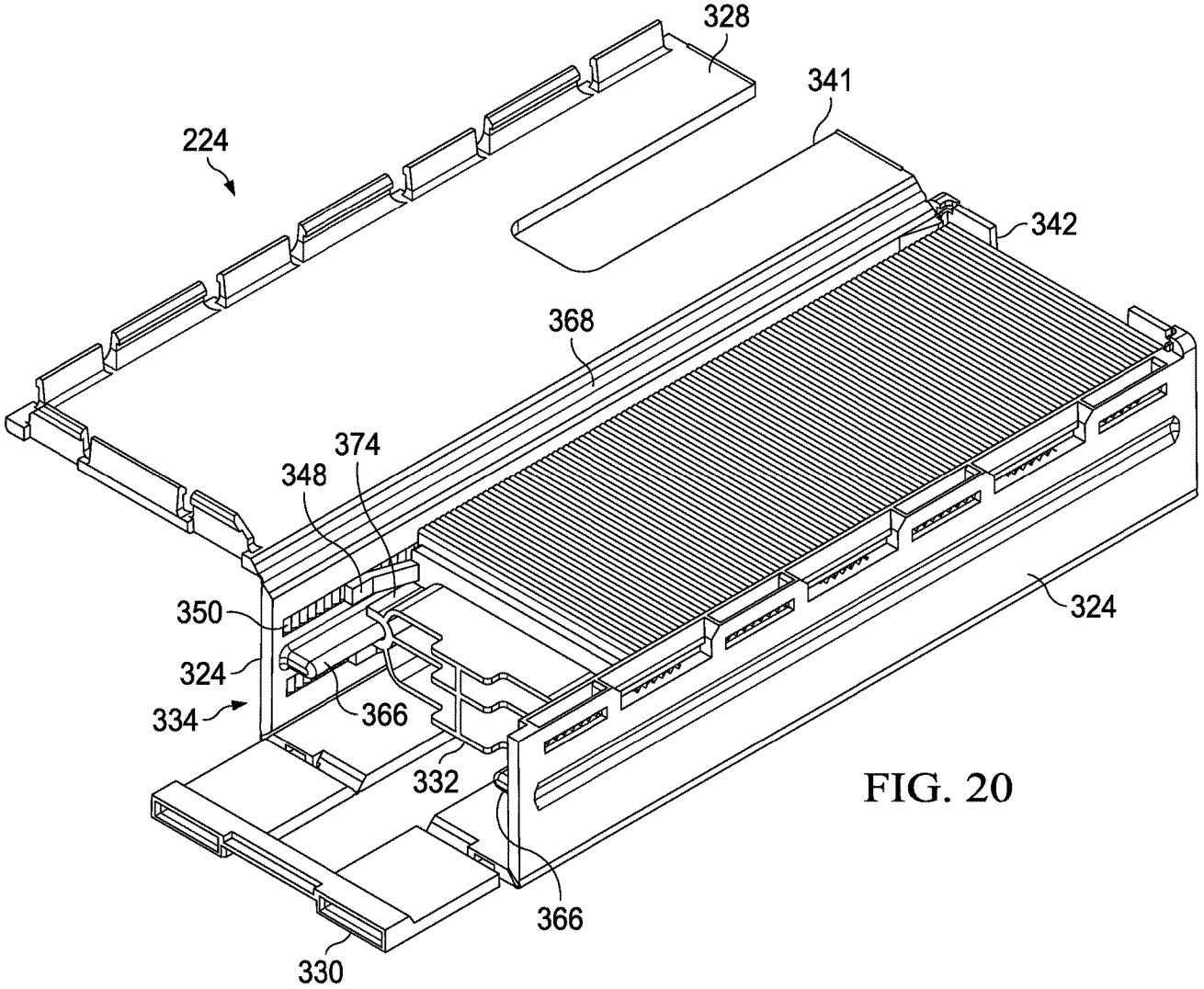
FIG. 20 is a diagrammatic rear isometric view of a blade carrier embodiment having a unitary body, shown in partially assembled form, including razor blades.
Figure 21:
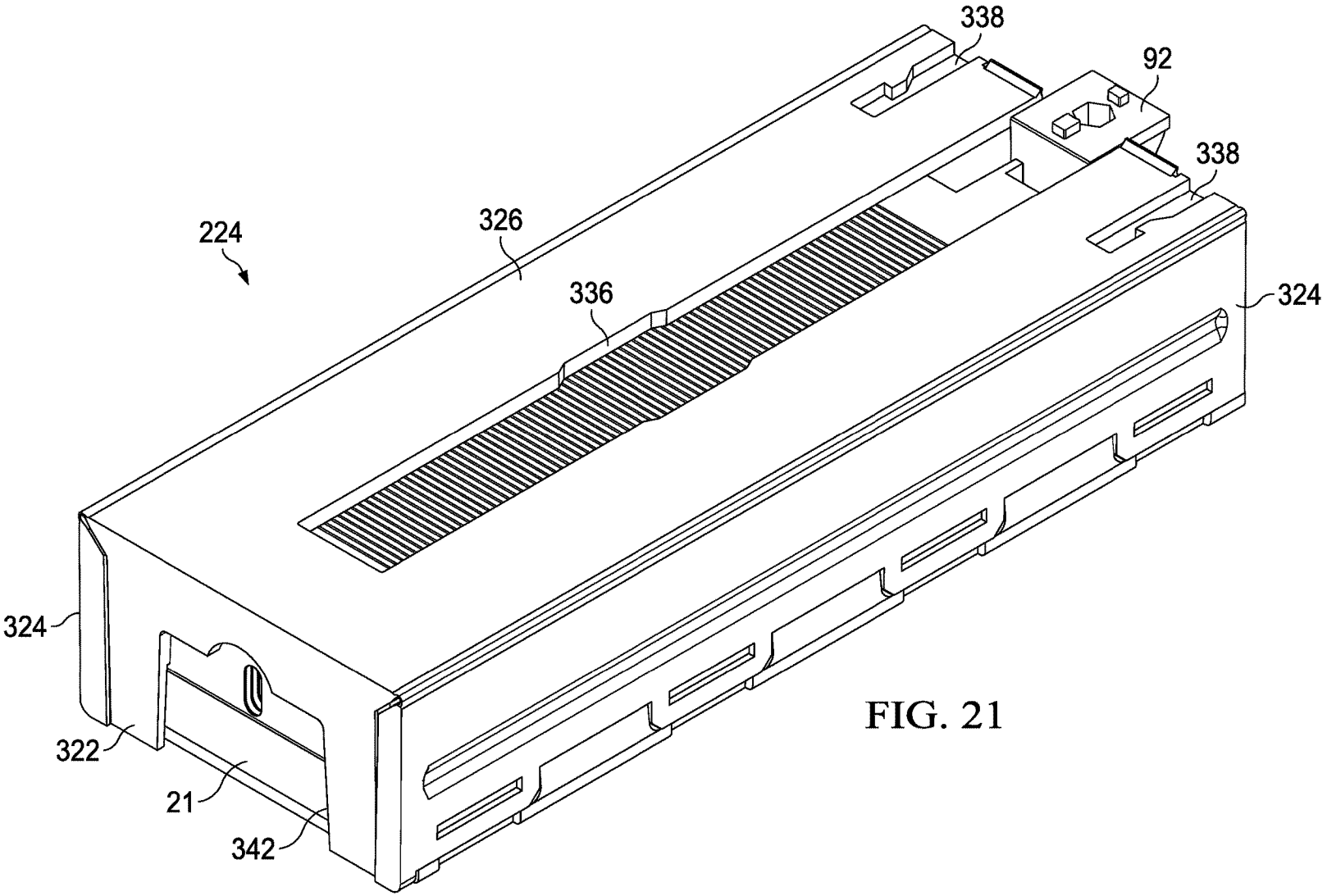
FIG. 21 is a diagrammatic bottom isometric view of a blade carrier embodiment having a unitary body, shown in assembled form, including razor blades and a sled.
Figure 22:
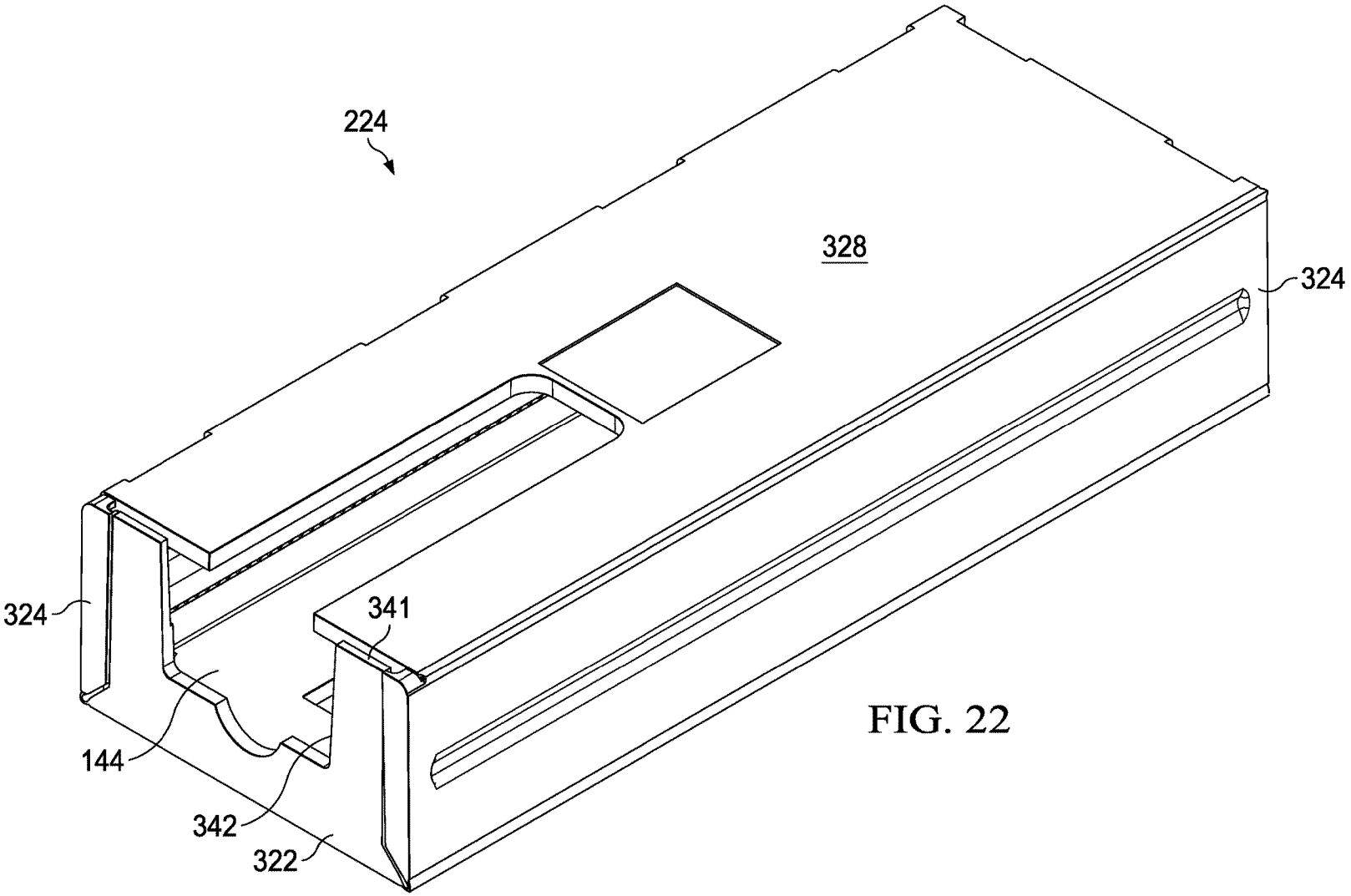
FIG. 22 is a diagrammatic top isometric view of a blade carrier embodiment having a unitary body, shown in assembled form.

In some embodiments, the blade carrier 224 may include one or more blade guide features disposed on one or more interior surfaces (i.e., surfaces facing blades disposed within the carrier). For example, as shown in FIGS. 19 and 20, a guide rib 366 extends outwardly from the interior surface of each side panel 324. Each guide rib 366 extends lengthwise and is configured to mate with (e.g., be received in) a cutout disposed on the respective side of each razor blade 21 disposed within the blade carrier 224. The guide ribs 366 may be disposed to support the blades 21 and allow the blades to slide lengthwise along the ribs 366, thereby providing clearance between the cutting edges of the blades 21 and the base panel 326 of the blade carrier 224. The present disclosure is not limited to the guide features described above. For example, if the blade carrier 224 is configured to hold a razor blade embodiment other than the type shown in FIGS. 19 and 20, the guide features may be configured to mate with guide features (or other blade geometry aspects) present in the type of razor blade.

As can be seen in FIGS. 19 and 20, in some embodiments the blade carrier 224 is constructed to allow assembly of the blade carrier 224 from a unitary body. For example, the unitary body may be a body (e.g., manufactured by molding, stamping, etc.) with respective panels (i.e., side panels 324, base panel 326, top panel 328, and back panel 330) connected to one another by integral hinges 368. The unitary body may further include attachment features 370 (e.g., mechanical features, etc.) that allow the respective panels to attach to one another to form the assembled blade carrier 224. The unitary body facilitates manufacturing of the blade carrier 224.

In a manner similar to that described above (e.g., dog 132, detent mechanism 134), the detent mechanism 334 is operable to positionally secure the dog 332, and may include a first portion (e.g., cantilevered arms 348) disposed with the dog 332 and a second portion (e.g., rows of teeth 350) disposed with the blade carrier 224. The detent mechanism 334 embodiment shown in FIGS. 19, 20, 24, and 25 includes a pair of cantilevered arms 348 disposed on each widthwise side of the dog 332 and a corresponding pair of teeth rows 350 disposed with the interior surface of the respective side panel 324. Each cantilevered arm 348 may include a plurality of teeth 372 extending outwardly from the cantilevered arm 348, spaced apart from one another at a one-half pitch increment to facilitate engagement with the teeth rows 350 in the respective side panel 324 and positioned relative thereto. The present disclosure is not limited to this particular detent mechanism embodiment.

The dog 332 may include guide features 374 that mate with the guide features 366 extending outwardly from the interior surfaces of the blade carrier 224. The respective mating guide features 366, 374 of the blade carrier 224 and the dog 332 facilitate relative movement.

Figure 26:
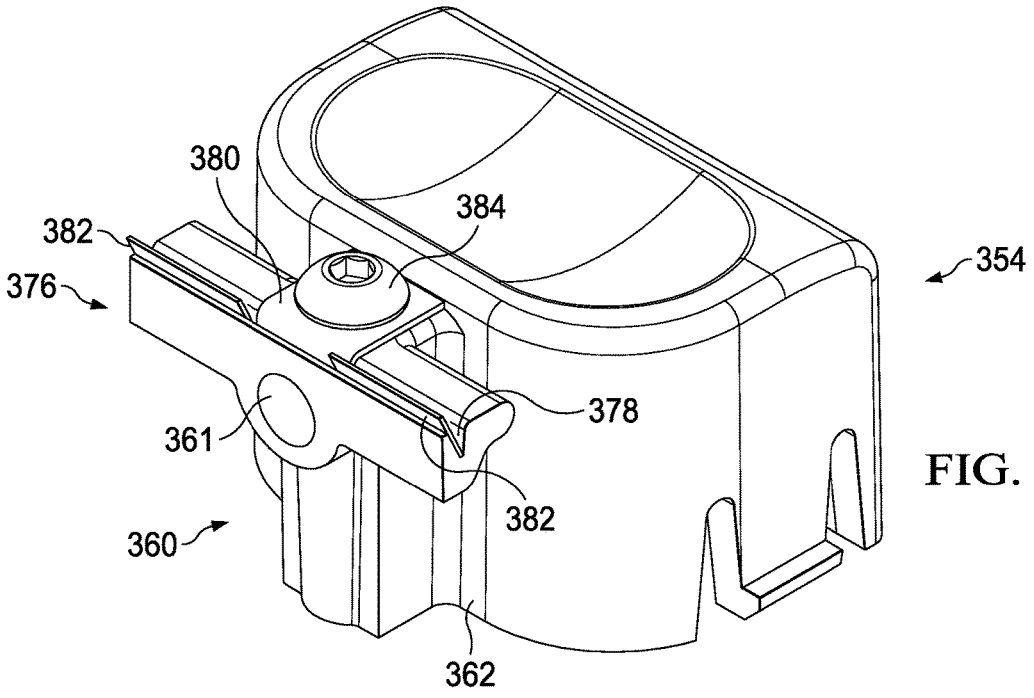
FIG. 26 is a diagrammatic isometric view of a blade eject assembly button embodiment.
Figure 27:
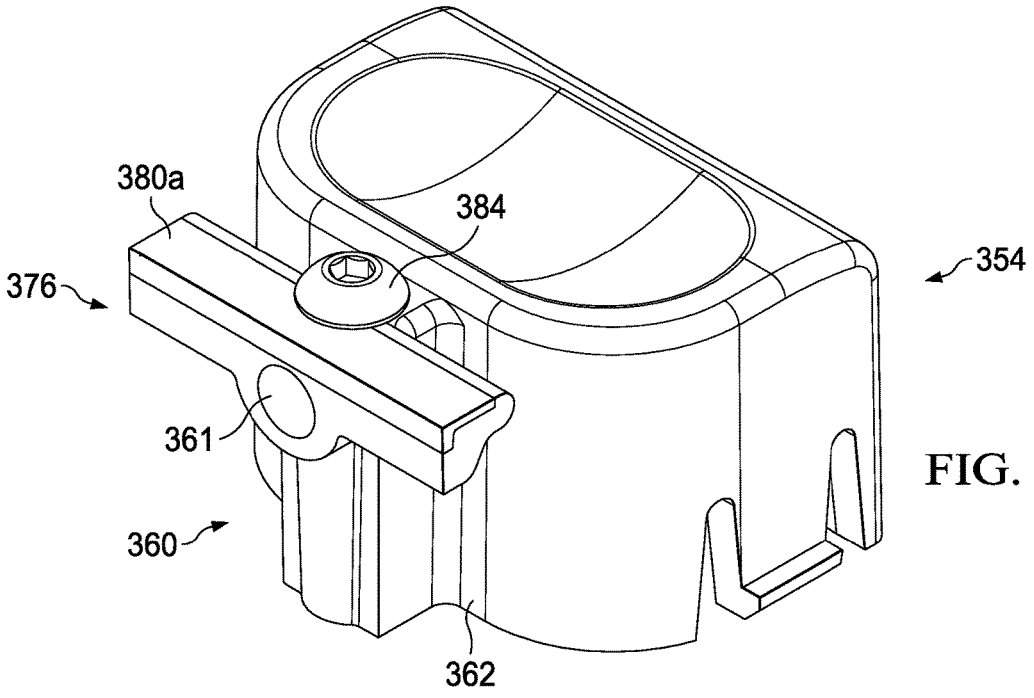
FIG. 27 is a diagrammatic isometric view of a blade eject assembly button embodiment.
Figure 28A:
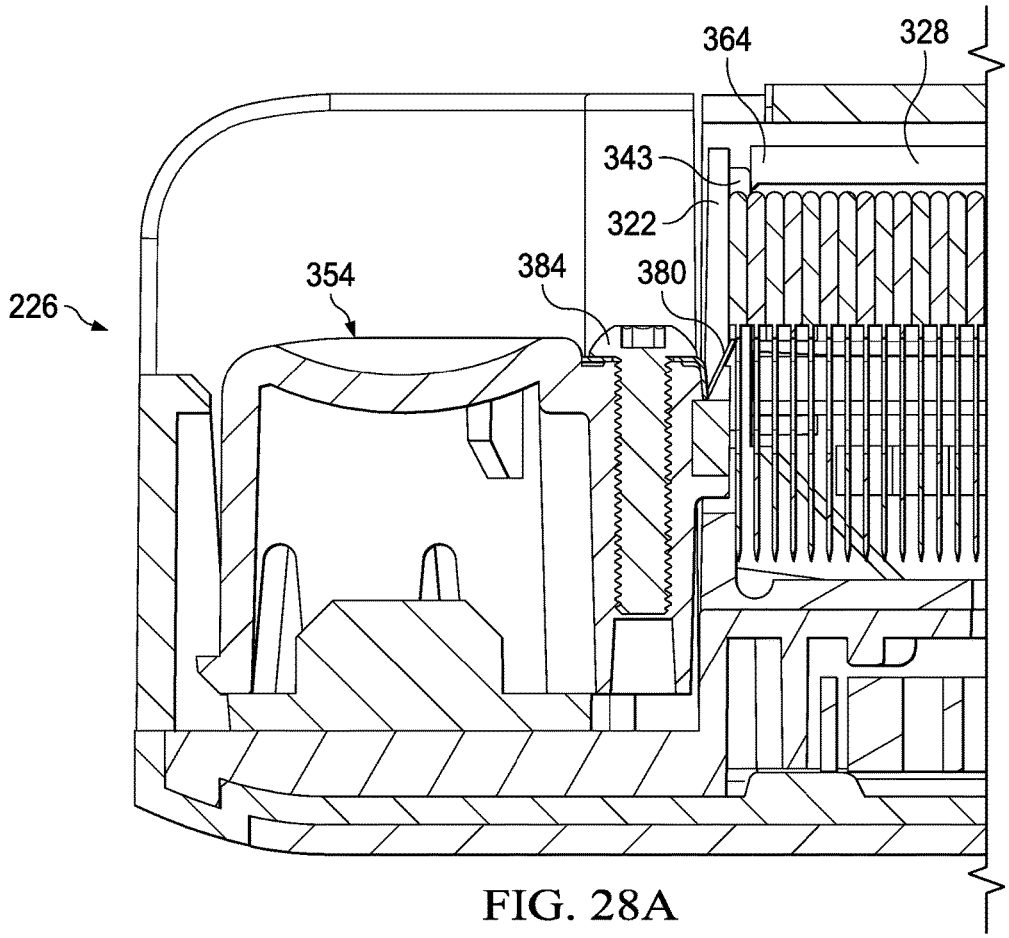
FIG. 28A is a sectional partial view of a blade dispenser embodiment, illustrating the blade eject assembly button in a depressed position.
Figure 28B:
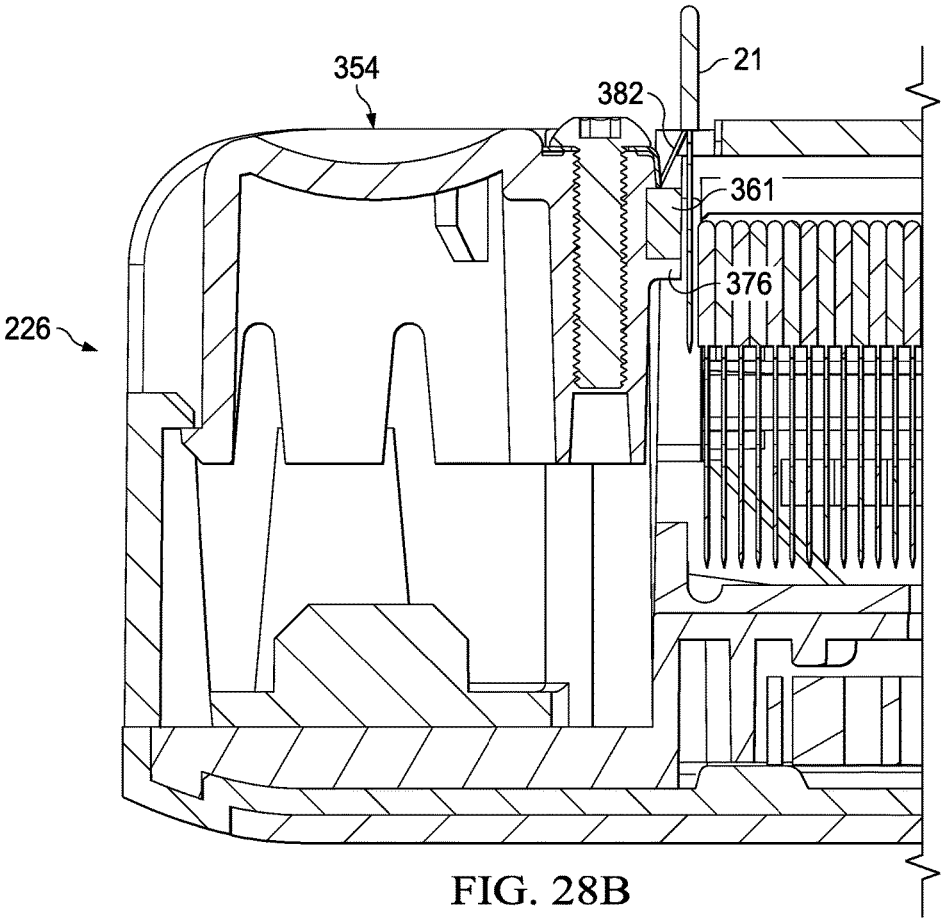
FIG. 28B is a sectional partial view of a blade dispenser embodiment, illustrating the blade eject assembly button in a non-depressed position.

Now referring to FIGS. 17, 26, 27, 28A, and 28B, in some embodiments the blade eject assembly 226 may include a blade eject assembly button 354 with an alternative blade engagement structure 360 configured to engage a blade 21 disposed in the carrier 224. The blade eject assembly button 354 is similar to the button 154 described above; e.g., the button may be spring biased, etc. The alternative blade engagement structure 360 is configured to engage the edge of the protective metal cap attached to a razor blade 21. The blade engagement structure 360 extends outwardly from a housing side surface 362 of the button 354, and includes a widthwise extending member 376 and a magnet 361. The widthwise extending member 376 has a length substantially equal to the width of a razor blade 21. In the embodiment shown in FIG. 26, the member 376 includes a slot 378 (e.g., V-shaped) disposed in a top surface of the member 376. In some embodiments, the blade engagement structure 360 further includes an insert 380 with at least one contactor 382 (two contactors are shown in FIG. 26) extending outwardly from the slot 378. The insert 380 may be comprised of a material that has a greater wear-resistance (e.g., greater hardness) than the material of the blade engagement structure 360. Preferably, the insert 380 is comprised of a hardened material (e.g., steel) that is wear-resistant. The insert 380 may be mechanically attached to the blade engagement structure 360 (e.g., by screw 384) to allow for replacement. The present disclosure is not limited to a blade engagement structure 360 having the configuration described above. For example, the blade engagement structure 360 may not include an insert, or may include an insert 380*a* that provides a wear resistant edge (e.g., greater hardness material as described above) as shown in FIG. 27.

Now referring FIGS. 1-28B, the general operation of the blade dispenser 20 (and blade dispenser 220) in terms of one or more of the embodiments described above will now be described to further illustrate the utility of the present disclosure. To facilitate the description of the general operation of the blade dispenser 20, 220, the following description does not specifically refer to each embodiment described above but is applicable to all embodiments unless specifically stated otherwise. The order of operation provided hereinafter is for description purposes only and is not limiting.

The dog 132 is moved within the carrier 24 toward the back panel 130, away from the front panel 122. A plurality of blades 21 is loaded into the carrier blade cavity 144 between the dog 132 and the front panel 122, with the sharp edges of the blades 21 proximate the base panel 126 of the carrier 24. The carrier 24 is not limited to any particular blade capacity, and the same blade dispenser 20 may be used with different capacity carriers 24 for different applications. In addition, a carrier 24 with a blade capacity of "N" blades (where "N" is an integer) may be loaded with less than "N" blades. Once the blades are loaded in the carrier 24, the dog 132 is moved forward snug against the rearward most blade 21.

FIG. 1 (and FIG. 16) shows the blade eject assembly 26 in a "closed" position; i.e., rotated to enclose the carrier cavity 52. In this position, the blade eject assembly latch button latch 88 is normally biased into engagement with slot disposed in the blade eject assembly base 152 by the blade eject latch button biasing mechanism 60 of the housing 22. When a user depresses the blade eject assembly latch button 34, the button pivots, the biasing mechanism 60 deflects, and the latch 88 disengages with the slot in the button base 152. Once disengaged, the blade eject assembly 26 can be rotated away from the housing 22 causing the carrier cavity 52 to be exposed. This position of the blade eject assembly 26 relative to the housing 22 may be referred to as the "open position".

The loaded carrier 24 is subsequently slid into the carrier cavity 52. Prior to sliding the carrier 24 into the carrier cavity 52, the blade loading mechanism sled 92 is biased forward, toward the open end 54 of the carrier cavity 52. As the carrier 24 is slid into the carrier cavity 52, the sled 92 is received within the carrier base panel slot 136 (i.e., extending at least partially into the blade cavity) until the sled 92 contacts the dog 132. As the carrier 24 is slid further into the carrier cavity 52, the sled 92 and carrier 24 are moved lengthwise aft toward the endwall panel 42 of the housing 22. As the sled 92 is moved backward, the blade loading mechanism 36 biases the sled 92 against the dog 132. More specifically, the flexible member 94 rotates around the pivotable member 96, which movement is resisted by the biasing element 98 thereby providing the force that biases the sled 92 against the dog 132.

As the carrier 24 is completely inserted into the carrier cavity 52, the latches of the carrier buttons 32A, 32B engage the latch slots 138 disposed in the carrier 24. Further lengthwise movement of the carrier 24 causes the carrier button latches 82 to encounter the ramped tooth 140 in each slot 138. Once the carrier button latches 82 pass the ramped teeth 140, the carrier latch biasing mechanisms 58 (e.g., the cantilevered tabs) attached to the housing 22 force the latches 82 widthwise outwardly and the carrier 24 is then secured in the carrier cavity 52 by the latches 82. The blade eject assembly 26 can then be rotated toward the housing 22 to enclose the carrier cavity 52. As the blade eject assembly 26 is rotated toward the housing 22 (i.e., toward the closed position), the assembly engages the blade eject assembly latch button 34 which subsequently prevents the assembly 26 from rotating away from the housing 22. In the closed position, a gap 164 (through which blades may be dispensed; see FIG. 1) remains between the top panel 118 of the cap 30 and the housing side surface 162 of the blade eject assembly button 154. Also, when the blade eject assembly 26 is in the closed position the blade engagement structure 160 of the button 154 (which extends out from the housing side surface) contacts a portion of the forward most blade 21 in the carrier 24.

When a user wishes to dispense a blade 21 from the blade dispenser 20, she depresses the blade eject assembly button 154. When the button 154 and blade engagement structure 160 are depressed sufficiently, the blade engagement structure 160 engages a feature (e.g., the protective metal cap attached to the blade) on the forward most blade 21 in the carrier 24. When the user releases the blade eject assembly button 154, the blade engagement structure 160 travels upwardly with the button 154 and causes the engaged blade 21 to also travel upwardly and enter the gap 164 between the top panel of the housing 22 and the housing side surface 162 of the blade eject assembly button 154. When the maximum height wise upward travel of the button 154 is completed, a portion of the engaged blade 21 is exposed where it can be readily and safely gripped by two fingers of the user and removed from the blade dispenser 20. When the blade 21 is removed from the carrier 24 (and therefore the dispenser), the sled 92 biased against the carrier dog 132 forces the carrier dog 132 forward thereby moving the then most forward blade 21 in the carrier 24 into a "to be dispensed" position. Thereafter, the blade dispenser 20 is ready to dispense the forward most blade 21. As indicated above, the detent mechanism 134 of the dog 132 inhibits rearward movement of the dog 132 and keeps the blades within the carrier 24 in the desired orientation.

When the user desires to remove the carrier 24 (e.g., because it is empty or to change the type of blade 21 being dispensed), the user depresses the blade eject assembly latch button 34 which causes the blade eject assembly latch button latch 88 to disengage with the blade eject assembly 26. Once disengaged, the blade eject assembly 26 can be rotated away into the open position, thereby exposing the carrier 24. The user may then depress the carrier buttons 32A, 32B. When the carrier buttons 32A, 32B are sufficiently depressed, the carrier button latches 82 disengage with the ramped teeth 140 in slots 138 disposed in the carrier 24 and the carrier 24 can be removed from the blade dispenser housing 22.

Although this invention has been shown and described with respect to the detailed embodiments thereof, it will be understood by those skilled in the art that various changes in form and detail may be made without departing from the spirit and scope of the invention. For example, the Detailed Description provided above describes embodiments of the blade dispenser 20 wherein the carrier 24 is inserted and removed from a forward portion of the device. In alternative embodiments, the carrier 24 could alternatively be accessed from a side vantage. As another example, the Detailed Description provided above details that a blade eject assembly latch button 34 portion of the housing includes structure that engages blade eject assembly 26 to hold the blade eject assembly 26 relative to the housing 22. In an alternative embodiment, the blade eject assembly 26 may include structure that engages the housing 22 to hold the blade eject assembly 26 relative to the housing 22.

What is claimed is:

1. A blade dispenser, comprising:

a housing defining a carrier cavity having an open end, the housing including a blade loading mechanism;

a carrier operable to hold a plurality of blades, the carrier selectively disposable within the carrier cavity of the housing; and a blade eject assembly having a button biased in a normal position relative to a base, wherein the button is operable to be moved relative to the base and engage a blade disposed within the carrier and move the blade to a position where at least a part of the blade is disposed outside the housing;

wherein the carrier has a length and includes a base panel having a lengthwise extending slot, and a dog operable to be selectively positioned at lengthwise positions within the carrier, and a detent mechanism operable to positionally secure the dog at lengthwise positions of the carrier;

wherein the housing includes at least one carrier button operable to engage the carrier disposed within the carrier cavity to selectively secure the carrier within the carrier cavity.

2. The blade dispenser of claim 1, wherein the housing includes a first carrier button disposed on a first side of the housing, and a second carrier button disposed on a second side of the housing, wherein each of the carrier buttons is operable to engage the carrier disposed within the carrier cavity to selectively secure the carrier within the carrier cavity.

3. The blade dispenser of claim 1, wherein the blade eject assembly is selectively positionable relative to the housing in an open position and in a closed position.

4. The blade dispenser of claim 1, wherein the blade eject assembly includes a blade engagement structure attached to the blade eject assembly button, the blade engagement structure being configured to engage one of the plurality of blades that the carrier is operable to hold.

5. The blade dispenser of claim 4, wherein the blade engagement structure extends outwardly from blade eject assembly button and includes a widthwise extending member having a length substantially equal to a width of the plurality of blades that the carrier is operable to hold.

6. A blade dispenser comprising:

a housing defining a carrier cavity having an open end, the housing including a blade loading mechanism;

a carrier operable to hold a plurality of blades, the carrier selectively disposable within the carrier cavity of the housing; and a blade eject assembly having a button biased in a normal position relative to a base, wherein the button is operable to be moved relative to the base and engage a blade disposed within the carrier and move the blade to a position where at least a part of the blade is disposed outside the housing;

wherein the blade eject assembly is pivotally mounted to the housing, and the housing includes at least one blade eject assembly latch button operable to secure the blade eject assembly relative to the housing.

7. The blade dispenser of claim 1, wherein the carrier includes one or more panels that define a blade cavity sized to contain a plurality of blades, the blade cavity having a cross-sectional geometry that accommodates the blades held within the carrier.

8. The blade dispenser of claim 7, wherein the one or more panels includes a front panel configured to receive a portion of the blade eject assembly button.

9. A blade dispenser comprising:

a housing defining a carrier cavity having an open end, the housing including a blade loading mechanism;

a carrier operable to hold a plurality of blades, the carrier selectively disposable within the carrier cavity of the housing; and a blade eject assembly having a button biased in a normal position relative to a base, wherein the button is operable to be moved relative to the base and engage a blade disposed within the carrier and move the blade to a position where at least a part of the blade is disposed outside the housing;

wherein the housing has a floor panel that includes a carrier surface and a bottom surface, the bottom surface being disposed opposite the carrier surface, and the floor panel including lengthwise extending slot that extends through the floor panel between the carrier surface and the bottom surface; and wherein the blade loading mechanism includes a sled, a flexible member, a pivotable member, and a biasing element, wherein the sled is configured for travel along the lengthwise extending slot disposed in the floor panel.

10. The blade dispenser of claim 9, wherein the sled includes a slot member extending between a bottom surface flange and a blade flange, the slot member being received within the lengthwise extending slot disposed in the housing floor panel, the bottom surface flange being disposed adjacent the bottom surface of the housing floor panel, and the blade flange being disposed adjacent the carrier surface of the housing floor panel; and wherein the flexible member is attached to the bottom surface flange of the sled and extends around at least a portion of the circumferential face of the pivotable member, and the biasing element is operable to bias the sled toward the open end of the carrier cavity of the housing.

11. The blade dispenser of claim 10, wherein the pivotable member is pivotally attached to the bottom surface of the housing floor panel.

12. The blade dispenser of claim 10, wherein the carrier has a length and includes a base panel having a lengthwise extending slot, and a dog operable to be selectively positioned at lengthwise positions of the carrier, and a detent mechanism operable to positionally secure the dog at the lengthwise positions of the carrier; and wherein the sled is positioned within the carrier cavity of the housing such that when the carrier is disposed within the carrier cavity, the sled extends through the lengthwise extending slot disposed in the base panel of a carrier.

13. The blade dispenser of claim 12, wherein the carrier includes one or more panels that define a blade cavity sized to contain a plurality of blades, the blade cavity having a cross-sectional geometry that accommodates the blades held within the carrier.

14. The blade dispenser of claim 13, wherein the sled is biased against the dog disposed within the blade cavity.

15. The blade dispenser of claim 14, wherein the biasing force of the sled against the dog is adequate to move the dog forward toward the open end of the carrier cavity.

16. A blade dispenser comprising:

a housing defining a carrier cavity having an open end, the housing including a blade loading mechanism;

a carrier operable to hold a plurality of blades, the carrier selectively disposable within the carrier cavity of the housing; and a blade eject assembly having a button biased in a normal position relative to a base, wherein the button is operable to be moved relative to the base and engage a blade disposed within the carrier and move the blade to a position where at least a part of the blade is disposed outside the housing;

wherein the carrier is a unitary structure that includes a plurality of panels and each panel is connected to another panel by a hinge, and the panels are configured to assemble and define a blade cavity sized to contain a plurality of blades, the blade cavity having a cross-sectional geometry that accommodates the blades held within the carrier.

17. A blade dispenser comprising:

a housing defining a carrier cavity having an open end, the housing including a blade loading mechanism;

a carrier operable to hold a plurality of blades, the carrier selectively disposable within the carrier cavity of the housing; and a blade eject assembly having a button biased in a normal position relative to a base, wherein the button is operable to be moved relative to the base and engage a blade disposed within the carrier and move the blade to a position where at least a part of the blade is disposed outside the housing;

wherein the blade eject assembly includes a blade engagement structure attached to the blade eject assembly button, the blade engagement structure being configured to engage one of the plurality of blades that the carrier is operable to hold;

wherein the blade engagement structure extends outwardly from blade eject assembly button and includes a widthwise extending member having a length substantially equal to a width of the plurality of blades that the carrier is operable to hold; and wherein the widthwise extending member includes a slot disposed in a top surface of the member.

18. The blade dispenser of claim 17, further comprising a selectively removable insert having at least one contactor, wherein the insert is attached to the blade engagement structure and the contactor extends outwardly from the slot.

19. The blade dispenser of claim 18, wherein the insert is comprised of a material having a hardness that is greater than a hardness of the blade engagement structure.

20. The blade dispenser of claim 17, further comprising a selectively removable insert having a contact edge comprised of a material having a hardness that is greater than a hardness of the blade engagement structure.

* * * * *